US005445422A

United States Patent [19]

Weinerman et al.

[11] Patent Number: 5,445,422

[45] Date of Patent: Aug. 29, 1995

[54] HANDLE OPERATED DRAW LATCH WITH SAFETY CATCH

[75] Inventors: Lee S. Weinerman, Medina; Arthur J. Kuminski, Parma, both of Ohio

[73] Assignee: The Eastern Company, Cleveland, Ohio

[21] Appl. No.: 278,008

[22] Filed: Jul. 20, 1994

Related U.S. Application Data

[63] Continuation-in-part of Ser. No. 65,283, May 21, 1993, abandoned, and a continuation-in-part of Ser. No. 8,629, May 21, 1993, abandoned.

[51] Int. Cl.[6] ..... E05C 19/14

[52] U.S. Cl. ..... 292/247; 292/250; 292/262; 292/282

[58] Field of Search ..... 292/247, 262, 282, 250, 292/286

[56] References Cited

U.S. PATENT DOCUMENTS

| | | | |
|---|---|---|---|
| D. 257,218 | 10/1980 | Eriksson | D8/336 |
| D. 333,775 | 3/1993 | Krape | D8/331 |
| D. 343,782 | 2/1994 | Gromotka et al. | D8/331 |
| 1,734,282 | 11/1929 | White | 292/250 |
| 3,519,298 | 7/1970 | Gley et al. | 292/113 |
| 3,936,082 | 2/1976 | Swanson | 292/113 |
| 4,116,479 | 9/1978 | Poe | 292/113 |
| 4,243,255 | 1/1981 | Hornak | 292/113 |
| 4,307,906 | 12/1981 | Schenk | 292/247 |
| 4,326,739 | 4/1982 | Schlueter | 292/247 |
| 4,493,133 | 1/1985 | Nilsson | 24/68 |
| 4,530,529 | 7/1985 | Poe et al. | 292/113 |
| 4,531,769 | 7/1985 | Glancy | 292/113 |
| 4,540,206 | 9/1985 | Frame et al. | 292/66 |
| 4,588,216 | 5/1986 | Hinds | 292/113 |
| 4,890,869 | 1/1990 | Langkamp, Jr. | 292/113 |
| 5,257,839 | 11/1993 | Nielsen et al. | 292/113 |
| 5,287,602 | 1/1994 | Dykstra | 24/463 |

OTHER PUBLICATIONS

Nielsen Hardware Corp. Catalog (1986) p. 30 Entitled "Adjustable Catch".

De—Sta—Co Advertising Sheet, Series MA50 "Pull Action Clamps," De—Sta—Co Company, Troy, Mich. 48007 (Date Unknown, But is Prior to May of 1992).

De—Sta—Co Catalog "The World of Clamping," pp. 23-28, 42-44 & 49-51, DE—Sta—Co Company, Troy, Mich. 48007 (Believed to Have Been Published Mar., 1993).

*Primary Examiner*—Philip C. Kannan

*Attorney, Agent, or Firm*—David A. Burge

[57] ABSTRACT

A handle operated, toggle type draw latch assembly is mountable on one of two members and is operable to selectively engage and disengage a latch-engageable formation connected to the other of the two members. The latch assembly includes a complexly configured operating handle that is pivotally connected near one end to a mounting base for movement relative to the base between closed and open positions, that provides a hand grip near its opposite end, and that, at locations between its opposite ends pivotally mounts a drawbar for movement between extended and retracted positions, and defines not only a pair of stops but also a catch-engageable formation. One stop engages the base when the handle is closed. The other stop engages the drawbar when the drawbar is retracted. When the handle is open, the drawbar can be pivoted into and out of extended positions for selectively embracing the latch-engageable formation. If the handle is pivoted to its closed position while the drawbar is extended to embrace the latch-engageable formation, the drawbar exerts force on the latch-engageable formation that tends to draw the two members relatively toward each other. A base-carried safety catch pivots between latched and unlatched positions for receiving and releasably retaining the catch-engageable formation of the handle when the handle is closed. Other features include a selection of drawbar embodiments and a choice of pivotal connections for use in coupling a selected drawbar to the latch handle.

52 Claims, 11 Drawing Sheets

HANDLE OPERATED DRAW LATCH WITH SAFETY CATCH

CROSS-REFERENCE TO RELATED APPLICATIONS

The present application is a continuation-in-part of each of two co-pending applications, namely utility application Ser. No. 08/065,283 filed May 21, 1993 by Lee S. Weinerman and Arthur J. Kuminski entitled HANDLE OPERATED DRAW LATCH WITH SAFETY CATCH, now abandoned, and design application Ser. No. 29/008,629 filed May 21, 1993 by Lee S. Weinerman and Arthur J. Kuminski entitled HANDLE OPERATED DRAW LATCH ASSEMBLY WITH LOCKABLE SAFETY CATCH, now abandoned, the disclosures of which are incorporated herein by reference.

Reference also is made to a related design application, the disclosure of which is incorporated herein by reference, entitled HANDLE OPERATED DRAW LATCH ASSEMBLY WITH LOCKABLE SAFETY CATCH, Ser. No. (Atty's Docket No. 5-036) filed (concurrently herewith) by Lee S. Weinerman and Arthur J. Kuminski.

BACKGROUND OF THE INVENTION

1. Field of the Invention

The present invention relates generally to a handle operated, toggle type draw latch for joining two members and for exerting force that tends to draw the two members relatively toward each other. More particularly, the present invention relates to a handle operated toggle latch that has a lockable safety catch for securely retaining the handle in a closed position until the safety catch is operated to release the handle for movement to an open position, and that utilizes a relatively complexly configured handle that cooperates in a variety of ways with other components of the latch to provide a number of desired features such as stops to limit the ranges of movement that can be executed by relatively movable components. Other features include a selection of drawbar embodiments and a choice of pivotal connections for use in coupling a selected drawbar to the latch handle.

2. Prior Art

Toggle latches of a variety of types have been proposed for use in releasably joining two relatively movable members. Usually, what is referred to as a "toggle latch" has at least a pair of pivotally interconnected, link-like components that are "toggled" through an "over center" position to effect latching and unlatching movements.

Toggle latches that are operable to releasably join and to draw two relatively movable members toward each other are sometimes referred to as "draw latches." Usually, a toggle-type draw latch includes a latch assembly that can be mounted on-a first of two relatively movable members, and has what is referred to as a "drawbar" that can be moved, when the latch is "open," into and out of connection with a latch-engageable formation that is connected to the second of the relatively movable members. When components of the latch are moved latchingly toward a "closed" position, the drawbar serves not only to engage the latch-engageable formation to join the first and second relatively movable members but also to exert force on the latch-engageable formation that tends to move the members relatively toward each other.

While some toggle-type draw latches rely solely on tension force that is applied through over-center connected components to retain latch components in their "closed" positions, proposals have been made to use spring acting safety catches of various forms to releasably retain latch components closed. Some proposed safety catches are mere leaf springs, portions of which are deflectable for movement into and out of latching engagement with relatively movable components—an arrangement that may not be well suited for use in a high-load application where vibration is present. Another safety catch proposal calls for the use of a spring-biased slide carried on one movable component for being received in an aperture defined by another movable component—an arrangement that involves no secure connection of the safety catch to a stationary base member, and that is not lockable to secure the safety catch.

Previously proposed handle operated, toggle type draw latches have not exhibited a desired degree of versatility. Toggle latches intended for different uses have tended to utilize toggle latch components that are quite differently configured. Basic operating components of such latches have not been designed with sufficient versatility in mind to permit their use, for example, with a variety of drawbar configurations, and with a selection of drawbar-to-handle connection components that not only provide different pivotal connection characteristics but also permit a selected degree of resilience (or no resilience at all) to be incorporated into their drawbar-to-handle connections.

While proposals also have been made to provide various forms of toggle latches with component-carried apertures that are alignable to receive the shanks of padlocks when the latches are closed, the alignable apertures typically have not been associated with base-mounted safety catches.

SUMMARY OF THE INVENTION

The present invention addresses the foregoing and other needs and drawbacks of the prior art by providing a novel and improved, handle operated, toggle type draw latch for joining two members and for exerting force thereon that tends to draw the two members relatively toward each other, with the latch including a base-carried spring-biased safety catch° that is padlockable not only to secure the safety catch but also to physically block opening movements of latch components by effectively locking the operating handle to the base of the latch.

In one preferred form of practice, the present invention provides a toggle type draw latch assembly that is mountable on one of two members and is operable to selectively engage and disengage a latch-engageable formation connected to the other of the two members, with the latch assembly including a complexly configured operating handle 1) that is pivotally connected near one end to a mounting base for movement relative to the base between closed and open positions, 2) that provides a handgrip near its opposite end, 3) that, at one location spaced between its opposite ends pivotally mounts a drawbar for movement between extended and retracted positions, and that, at other locations spaced along its length 4) defines one stop that engages the base when the handle is closed, 5) defines another stop that engages the drawbar when the drawbar is retracted, and 6) defines a catch-engageable formation that is latchingly engaged by a spring-biased safety catch when the handle is closed. Moreover, when the handle is latched closed by the safety catch, the safety catch can be secured by a padlock that concomitantly locks the handle to the base.

A feature of the preferred practice of the present invention resides in the provision of an drawbar that can have its effective length adjusted, and in the provision of a handle-defined stop formation for engaging the drawbar when it is retracted. The stop formation takes a generally triangular-shaped form that provides an inclined surface that extends along a selected portion of the length of the handle to assure that, regardless of where within its range of adjustment that the effective length of the drawbar is set, the drawbar will, nonetheless, properly engage the inclined surface of the stop formation when the drawbar is retracted. In accordance with most preferred practice, the drawbar-engageable stop formation is located adjacent a handgrip that is defined by a distal end region of the handle, with the inclined surface of the stop formation being oriented to hold the retracted drawbar increasingly farther away from a centerline of the handle grip as the adjusted effective length of the retracted drawbar brings the drawbar into increasingly closer proximity to the handle grip when the drawbar is retracted—a safety feature to ensure that the retracted drawbar is kept a suitable distance away from where one's hand engages the handgrip.

Still another feature of the preferred practice of the present invention resides in forming the handle from a pair of handle components that are fastened securely together in regions where the handle components cooperate to define the drawbar-engageable stop and the hand-grip, and that extend in spaced relationship to form a yoke-shaped structure that is provided with one set of aligned holes to receive a first pivot pin that connects the handle to the base structure, and another set of aligned holes to receive a second pivot pin that connects the handle to the drawbar. An optional torsion coil spring may be provided to extend about the second pivot pin in the space that is provided between the second set of aligned holes, with the spring having a center portion that engages a projecting pin that is driven into a hole that extends diametrically through the second pivot pin, and that has end regions that engage the handle to bias the second pivot pin to pivot the drawbar toward its retracted position.

Also addressed by the present invention is the need, mentioned above, to provide a handle operated, toggle type draw latch that utilizes basic operating components that are of sufficiently versatile design to permit their being used with a variety of drawbar configurations and drawbar-to-handle connection components that give rise to a family of latch products featuring a variety of operating characteristics that can be produced using simple sets of interchangeable parts. Rigid and semi-rigid drawbar components of a variety of configurations are provided.

Each of the drawbars preferably incorporates a threaded adjustment that permits the "effective length" of the drawbar (relative to a so-called "second pivot pin" that connects the drawbar to the operating handle of the latch) to be adjusted as desired. "Second pivot pins" that can pivot relative to the operating handle either 1) about a single axis (thereby offering only one "degree of freedom" of relative movement) or 2) about a point (thereby offering plural "degrees of freedom" of relative movement) also can be chosen for use with a drawbar of selected configuration to give the resulting latch operating characteristics that are chosen to be correct for use in a particular application.

Optional compression coil springs may be installed to extend about threaded portions of the drawbars to give the drawbars something of an "automatically adjustable effective length" that "self-adjusts" in response to variations in tension force encountered by the drawbar during use. The compression coil springs also provide something of a "cushioning action" that permits a limited degree of relative movement to take place between the two members that are joined and drawn toward each other by the latch assembly.

In preferred practice, the safety catch includes a mounting bracket 1) that is welded to the base structure of the latch assembly, 2) that has spaced upstanding projections for defining aligned holes which mount a pivot pin, 3) that is pivotally connected by the pivot pin to a thumb releasable catch member for relative pivotal movement between latched and unlatched positions, and 4) that has a Z-shaped leaf spring interposed between the mounting bracket and the thumb-operable catch member for biasing the catch member toward its latched position. The catch member preferably is configured and positioned to be engaged by a catch-engageable formation of the handle and cammed away from its latched position as the handle is moved toward its fully closed position. When the handle reaches its closed position, the spring-biased catch member snaps into latched engagement with the catch-engageable formation of the handle to releasably retain the handle closed.

The catch member preferably defines an aperture through which the shackle of a padlock can be inserted as the padlock is being installed to embrace portions of the handle and of the mounting bracket to concomitantly secure the catch member latched while locking the handle to the base. Optionally, the handle and the base also may be provided with aperture-defining formations that extend in juxtaposed relationship with their apertures aligned when the handle is latched closed to receive a padlock shackle that also extends through the catch-defined aperture to strengthen the manner in which the padlock concomitantly secures the safety catch and locks the handle to the base.

To summarize, in preferred practice, the present invention provides a toggle type draw latch that incorporates a number of desirable features while employing a simple set of well-designed, highly interactive components that are relatively inexpensive to manufacture and that are easy to assemble and adjust to provide latch assemblies that function as may be required for use in particular applications.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Referring to FIGS. 1–15, a first embodiment of handle operated draw latch assembly with safety catch incorporating features of the preferred practice of the present invention is indicated generally by the numeral 100. Because many of the features of the latch assembly 100 are arranged in a substantially symmetrical manner about an imaginary "center plane," reference is made to FIGS. 3 and 12–15 wherein what will be referred to as the "center plane" of the latch assembly 100 is indicated generally by the numeral 125.

Figure 16:
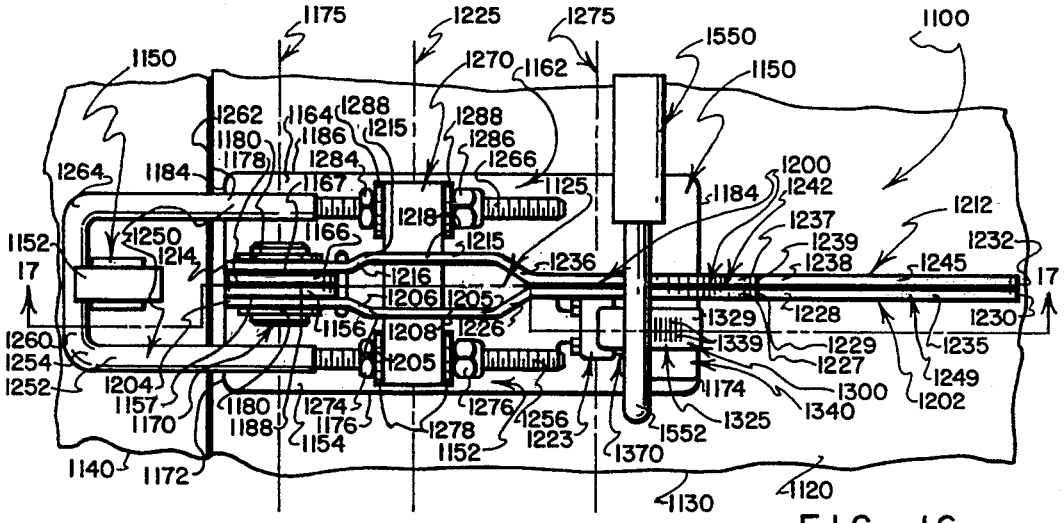
FIG. 16 is a top plan view similar to FIG. 10 but showing a second embodiment of handle operated, toggle-type draw latch with safety catch that embodies selected features of the first latch assembly embodiment that is depicted in FIGS. 1-15.
Figure 17:
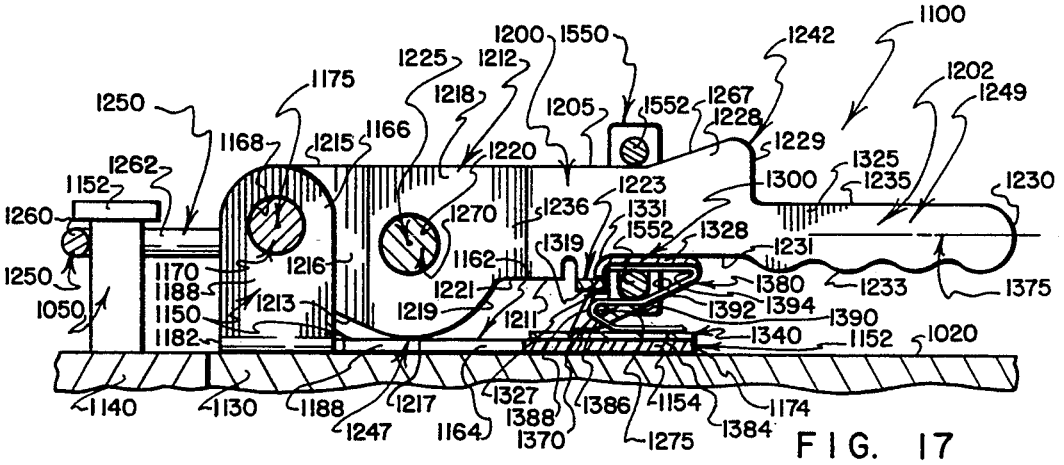
FIG. 17 is a sectional view thereof, as seen from planes that are indicated by the broken line 17—17 in FIG. 16.

Referring briefly to FIGS. 16 and 17, a second embodiment of handle operated draw latch assembly with safety catch (that incorporates only a selected number of features of the latch assembly 100) is designated generally by the numeral 1100. Because the only difference between the latch assemblies 100 and 1100 is that the latch assembly 1100 (as depicted in FIGS. 16 and 17) incorporates a lesser number of the features that will be described in conjunction with the latch 100 (as depicted in FIGS. 1–15), the extent to which there is correspondence between components that are used in the latches 100 and 1100 will be made clear by the use in FIGS. 16 and 17 of reference numerals that are identical to those that are used in FIGS. 1–15 except that the "corresponding numerals" used in FIGS. 16 and 17 have been increased in magnitude by adding "one thousand" thereto. Thus, for example, when the latch 100 is described as having a handle 200 and a drawbar 250, it will be understood that the numerals 1200 and 1250 as used in FIGS. 16 and 17 designate a "corresponding" handle 1200 and a "corresponding" drawbar 1250 of the latch embodiment 1100.

Figure 18:
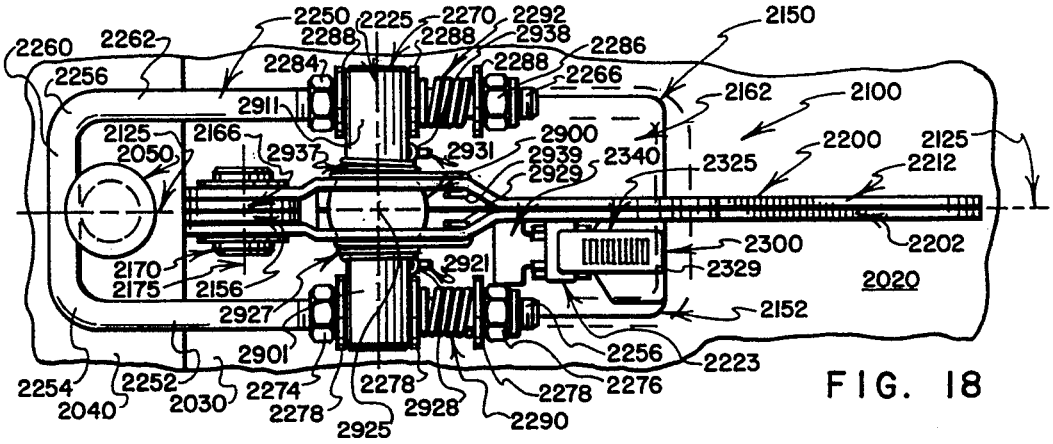
FIG. 18 is a top plan view similar to FIGS. 3 and 10 but showing a third embodiment of handle operated, toggle-type draw latch with safety catch with its drawbar shown in solid lines in an extended position embracing a latch-engageable post formation (and shown in phantom in a retracted position) with both of the drawbar-mounted compression coil springs shown compressed, and with the handle of the latch assembly being retained in its closed position by a safety catch that is shown in its normal, non-operated position.
Figure 19:
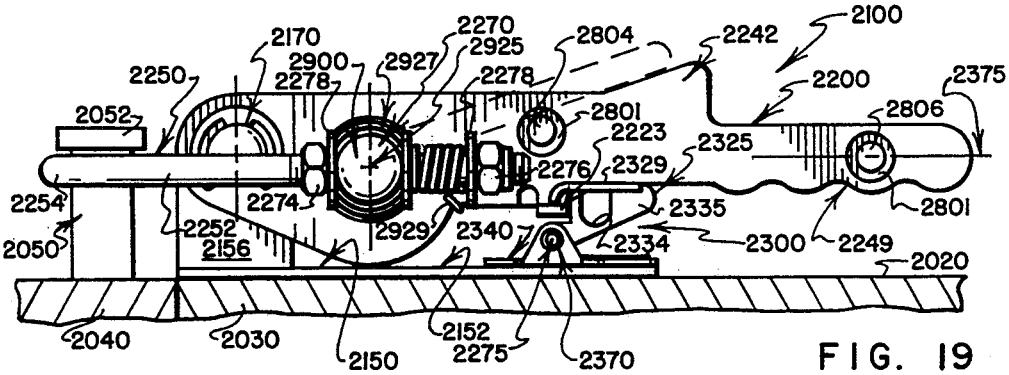
FIG. 19 is a front side elevational view thereof.
Figure 20:
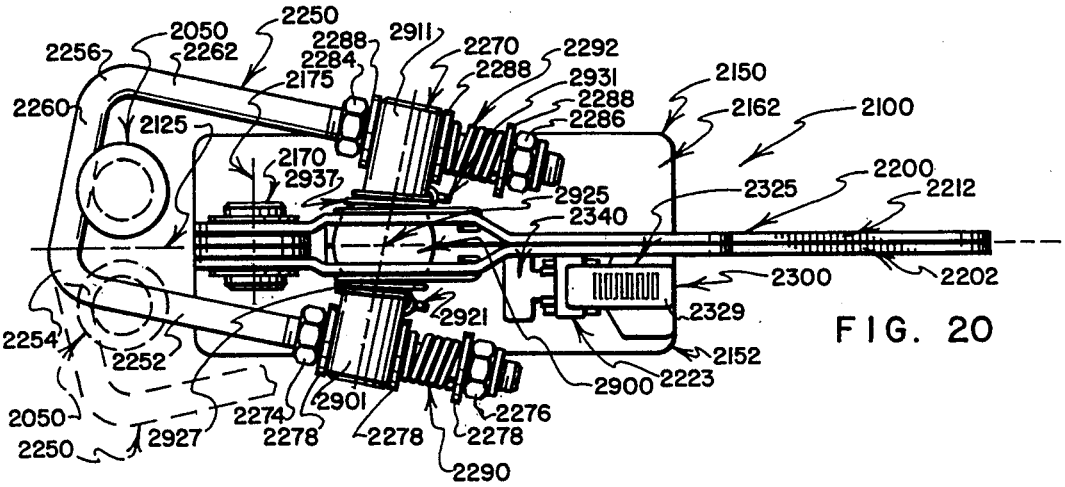
FIG. 20 is a top view similar to FIG. 18, but with the drawbar shown in solid lines pivoted to one side to engage a latch-engageable post formation that is depicted in solid lines as being in one non-aligned position (and with the drawbar shown in phantom pivoted to an opposite side to engage a latch-engageable post formation that is depicted in phantom in another non-aligned position)
Figure 21:
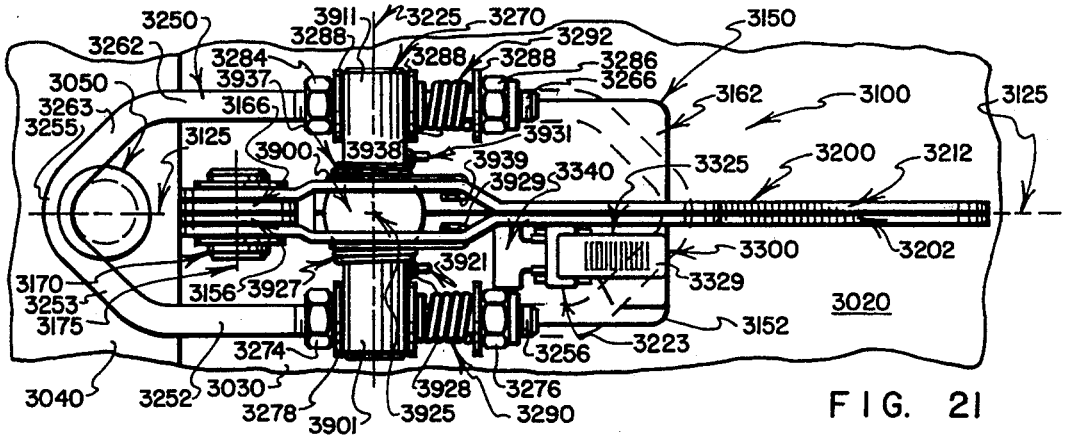
FIG. 21 is a top plan view similar to FIGS. 3, 10 and 18 but showing a fourth embodiment of handle operated, toggle-type draw latch with safety catch with its drawbar shown in solid lines in an extended position embracing a latch-engageable post formation (and shown in phantom in a retracted position), with both of the drawbar-mounted compression coil springs shown compressed, and with the handle of the latch assembly being retained in its closed position by a safety catch that is shown in its normal, non-operated position.
Figure 22:
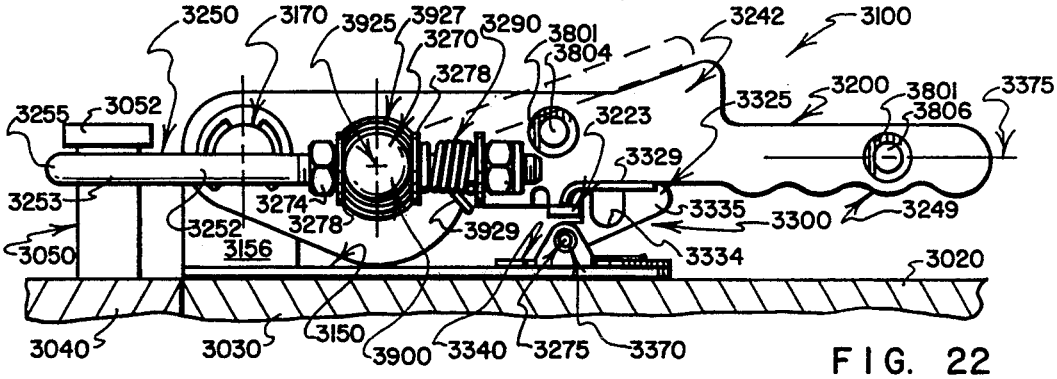
FIG. 22 is a front side elevational view thereof.
Figure 23:
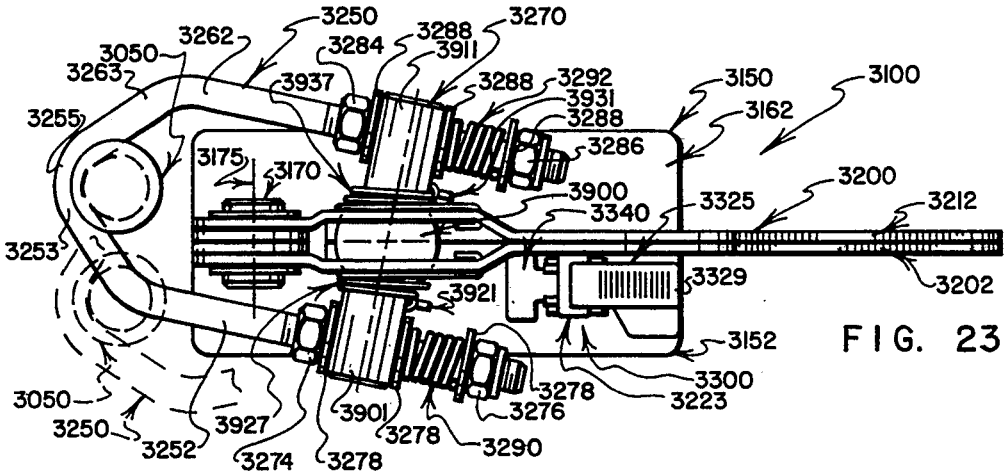
FIG. 23 is a top view similar to FIG. 21, but with the drawbar shown in solid lines pivoted to one side to engage a,latch-engageable post formation that is depicted in solid lines as being in one non-aligned position (and with the drawbar shown in phantom pivoted to an opposite side to engage a latch-engageable post formation that is depicted in phantom in another non-aligned position)
Figure 24:
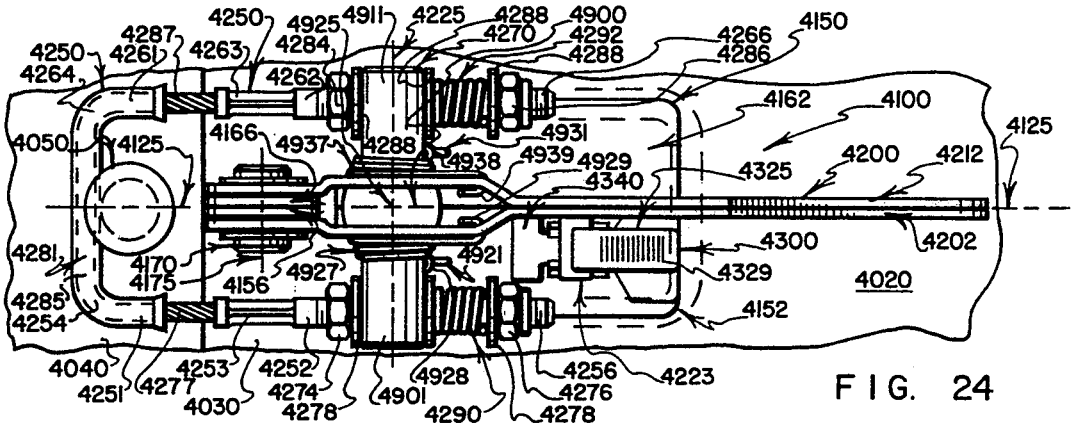
FIG. 24 is a top plan view similar to FIGS. 3, 10, 18 and 21 but showing a fifth embodiment of handle operated, toggle-type draw latch with safety catch with its drawbar shown in solid lines in an extended position embracing a latch-engageable post formation (and shown in phantom in a retracted position), with both of the drawbar-mounted compression coil springs shown compressed, and with the handle of the latch assembly being retained in its closed position by a safety catch that is shown in its normal, non-operated position.
Figure 25:
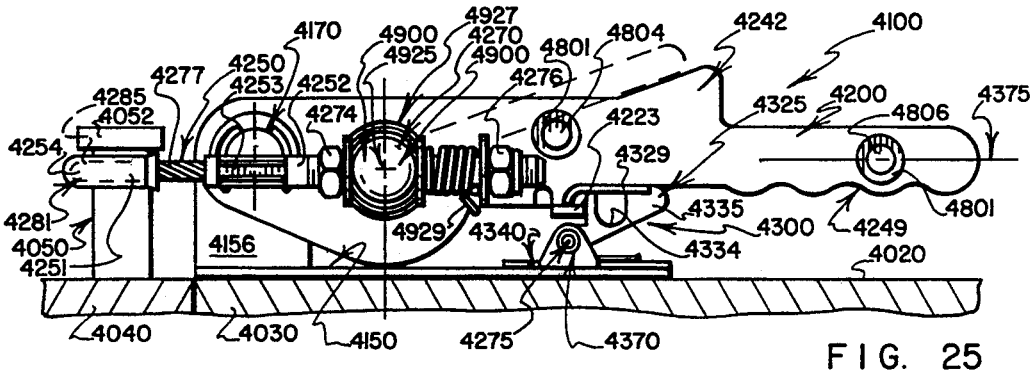
FIG. 25 is a front side elevational view thereof.
Figure 26:
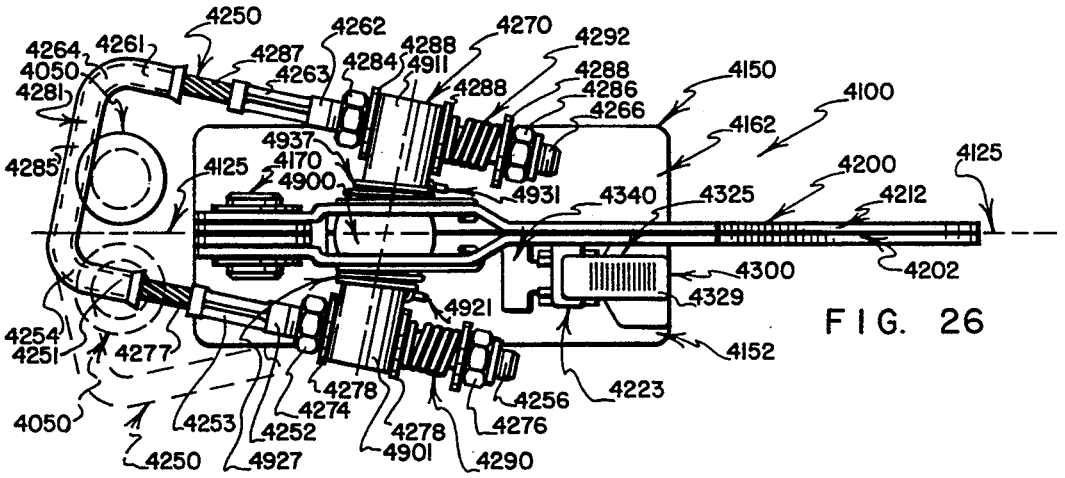
FIG. 26 is a top view similar to FIG. 24, but with the drawbar shown in solid lines pivoted to one side to engage a latch-engageable post formation that is depicted in solid lines as being in one non-aligned position (and with the drawbar shown in phantom pivoted to an opposite side to engage a latch-engageable post formation that is depicted in phantom in another non-aligned position); and, FIG. 27 is an exploded perspective view that selectively depicts components of the handle and drawbar sub-assemblies utilized by the third, fourth and fifth embodiments.

Likewise, with respect to a third latch embodiment 2100 that is depicted in FIGS. 18–20, a fourth latch embodiment 3100 that is depicted in FIGS. 21–23, and a fifth latch embodiment 4100 that is depicted in FIGS. 24–26, "corresponding numerals" are used to designate "corresponding components." Corresponding components of the third and first embodiments are designated by numerals that differ by a magnitude of two thousand. Corresponding components of the fourth and first embodiments are designated by numerals that differ by a magnitude of three thousand. Corresponding components of the fifth and first embodiments are designated by numerals that differ by a magnitude of four thousand.

In view of the foregoing explanation, it will be understood that the use made herein of "corresponding numerals" eliminates the need to repeat feature descriptions that are applicable to a plurality of depicted embodiments. The description of the first latch embodiment 100 that follows is applicable to the second, third, fourth and fifth latch embodiments 1100, 2100, 3100 and 4100 insofar as features that are designated "corresponding numerals" are concerned. To the extent that some features of the first and second embodiments 100 and 1100 do not carry over to the third, fourth and fifth embodiments 2100, 3100 and 4100, it will be found that alternative features that are shared by the third, fourth and fifth embodiments (but not by the first and second embodiments) are introduced in conjunction with a discussion of the third embodiment 2100.

In the detailed description that follows, orientation terms such as "front," "rear," "left" and "right," and orientation expressions such as "leftwardly extending, "rightwardly extending, "vertically extending" and "horizontally extending" are not intended to be viewed as suggesting that the latch assemblies 100, 1100 can only be used if oriented in a particular manner. Rather, orientation terms and expressions are used merely as an expedient in rendering the description clear and easy to follow, as those who are skilled in the art will readily understand. Indeed, a significant feature of the latch assemblies 100, 1100, 2100, 3100, 4100 resides in the fact that they can be used in a wide variety of orientations, especially inasmuch as each of the latch assemblies 100, 1100, 2100, 3100, 4100 incorporates a "safety catch" that not only will serve to releasably retain an associated operating handle in its closed position, but also can be "padlocked" to further assure that, regardless of latch orientation, the operating handle will be securely retained in its closed position.

Figure 2:
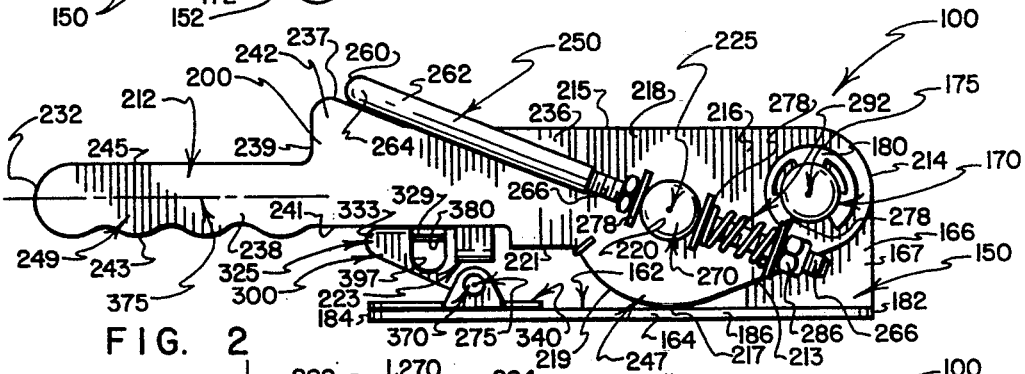
FIG. 2 is a rear side elevational view thereof, with the components thereof positioned in agreement with what is depicted in FIG. 1.

With the exception of FIG. 2 (which is deliberately "reversed" relative to the other drawing views to depict typical rear side features of a latch that embodies features of the preferred practice of the present invention), it will be understood that when a latch component is said to be "left" or "leftwardly extending" in character, such component is likely to be found toward the left side (except in FIG. 2 where "left" components appear toward the right side). Likewise, "right" and "rightwardly extending" components are likely to be found toward the right side (except in FIG. 2 where "right" components appear toward the left side).

Figure 3:
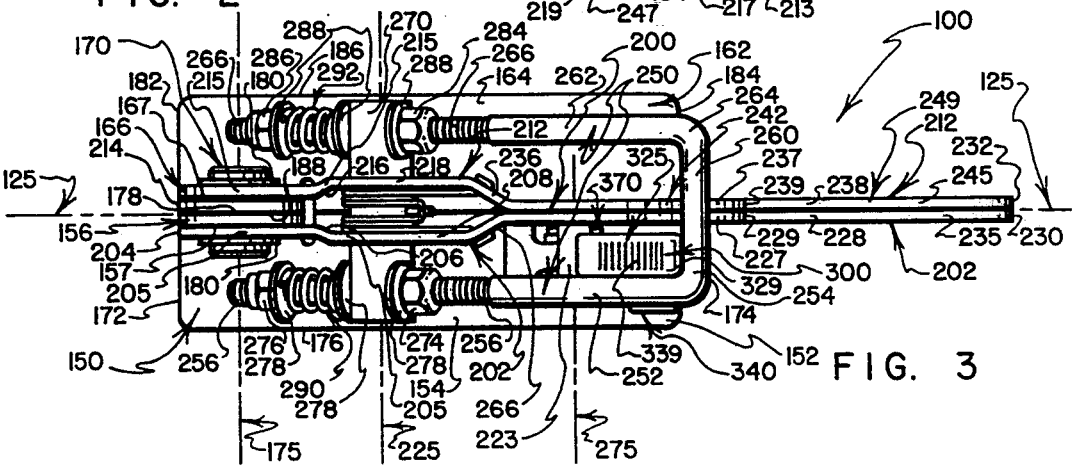
FIG. 3 is a top plan view thereof, with the components thereof positioned in agreement with what is depicted in FIGS. 1 and 2.
Figure 10:
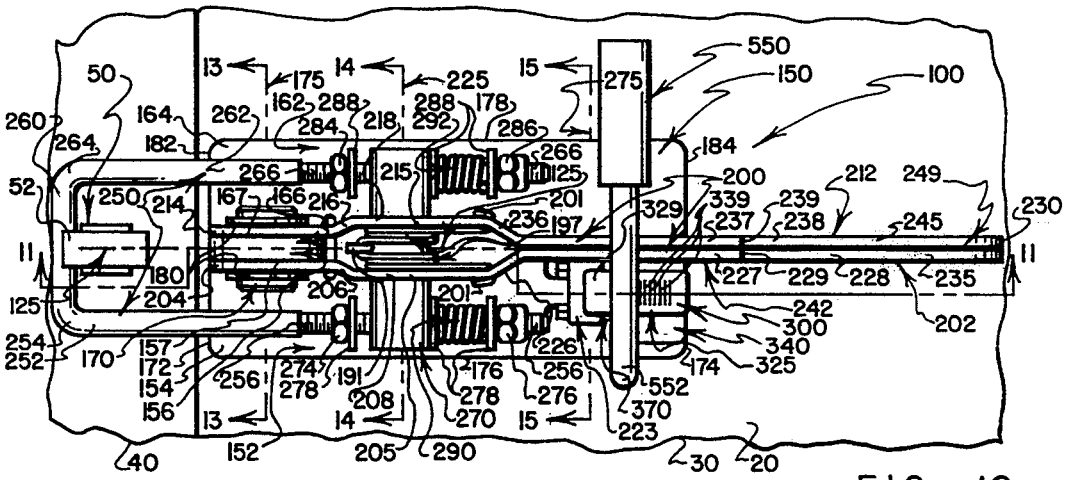
FIG. 10 is a top plan view similar to FIG. 3 but with the view showing both the latch assembly and the latch-engageable post formation, with the drawbar shown embracing the latch-engageable post formation, with both of the drawbar-mounted compression coil springs shown compressed, and with the handle locked closed and the safety catch locked in its normal position by means of a padlock that is installed on the latch assembly.

In top plan views (such as FIGS. 3 and 10), components or features located below a horizontally extending center plane line (such as is indicated in FIGS. 3 and 10 by the numeral 125) will be said to be "front" or "forwardly extending" in character, while components or features located above the center plane line will be said to be "rear" or "rearwardly extending" in character.

In overview, and referring variously to FIGS. 1–15, the latch assembly 100 includes among its more major components a base assembly (or "base") that is indicated generally by the numeral 150, an elongate handle assembly (or "handle") that is indicated generally by the numeral 200, a U-shaped drawbar assembly (or "drawbar") that is indicated generally by the numeral 250, and a safety catch assembly (or "safety catch") that is indicated generally by the numeral 300. A first pivot pin 170 extends along an axis 175 to pivotally interconnect the base 150 and the handle 200. A second pivot pin 270 extends along an axis 225 to pivotally interconnect the handle 200 and the drawbar 250. A third pivot pin 370 extends along an axis 275 to pivotally interconnect a latching component 325 of the safety catch 300 to a mounting bracket 340 of the safety catch 300 that is welded to the base 150.

Figure 7:
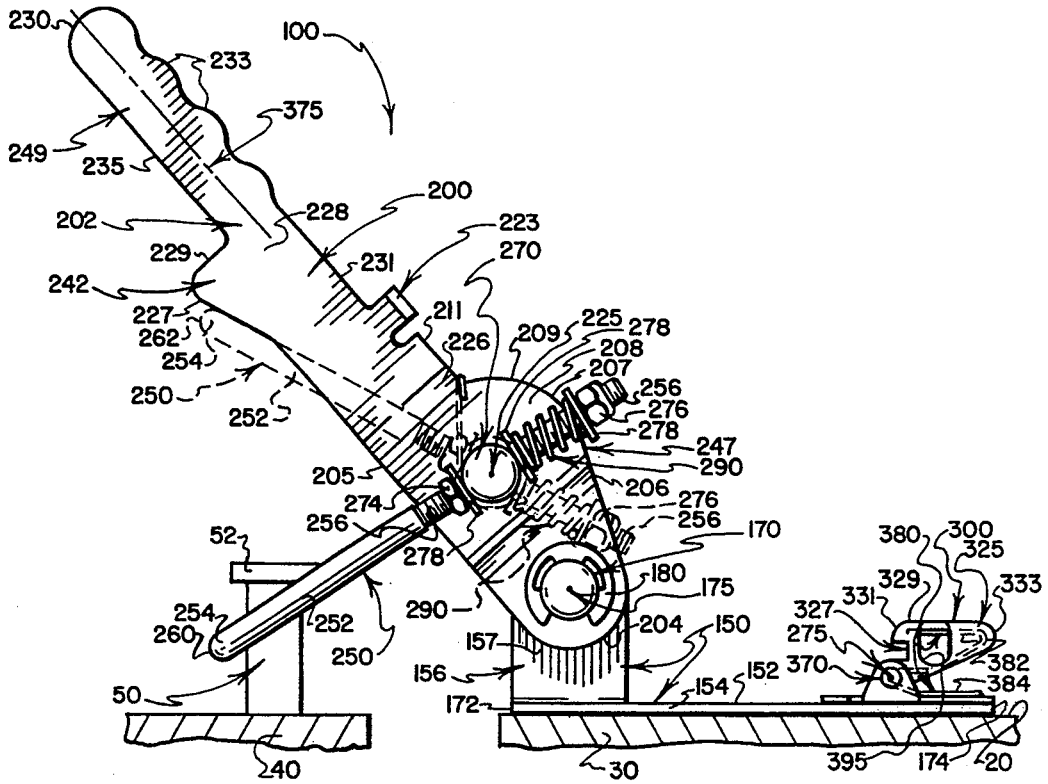
FIG. 7 is a front side elevational view of the mounted latch assembly and of a latch-engageable post formation that is connected to a member that is to be joined to the member on which the latch assembly is mounted, with the members on which the latch assembly and the latch-engageable post formation are mounted being spaced relatively far apart, with the handle shown pivoted to another of many possible open positions, with the drawbar shown in solid lines as as having been pivoted to an extended position wherein the drawbar embraces the latch-engageable post formation (and shown in phantom in a retracted position), with one of the drawbar-mounted compression coil springs shown minimally compressed, and with the safety catch shown in its normal, non-operated position.

Referring to FIGS. 7–11, the handle operated draw latch assembly 100 typically is used in concert with a suitably configured latch-engageable post formation such as is indicated generally by the numeral 50. An enlarged head formation 52 is provided atop the post 50. In preferred practice, the latch assembly 100 is mounted atop a surface 20 of one of two relatively movable members 30, 40 that are to be "joined" by drawing the members 30, 40 relatively toward each other from a separated position, such as is depicted in FIG. 7, to a more closely juxtaposed position, such as is depicted in FIGS. 8–11. The "drawing together" function of the latch assembly 100 has caused the term "draw latch" to be relatively commonly associated with latches that perform such a function.

Moreover, because the latch assembly 100 has handle and drawbar components 200, 250 that are pivotally connected for relative movement about the pivot axis 225, with the handle 200 being pivotally connected to the base 150 for relative movement about the pivot axis 175, and with the drawbar 250 in essence establishing a "partially pivotal connection" with the latch-engageable post formation 50 (compare how the drawbar 250 is angled upwardly in FIG. 7 with how the drawbar is more nearly horizontally inclined in FIGS. 8 and 9), the pivotally interconnected "links" 200, 250 are viewed by some as constituting "toggle links" that are alignable "on center" and that pass "over center" to utilize such forces as are incurred by the components 200, 250 to selectively assist in effecting "latching" and "unlatching" movements—which arrangement has given rise to this general type of latch being referred to as a "toggle type latch," or more simply as a "toggle latch."

Figure 4:
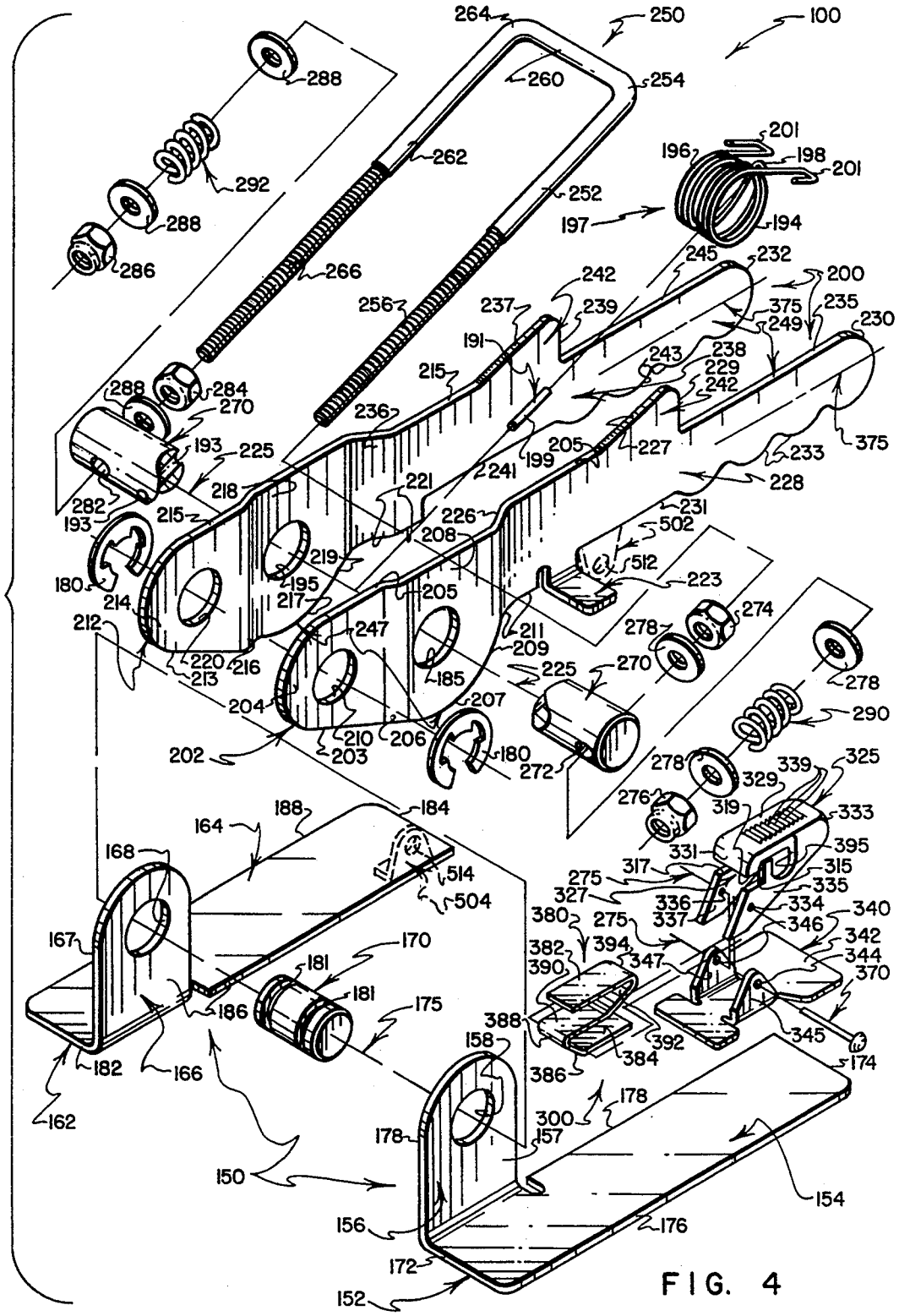
FIG. 4 is an exploded perspective view showing components of the latch assembly, with optional formations that can be provided on one of the base members and on one of the handle members for receiving a padlock shackle when the handle is latched closed being depicted in phantom.
Figure 13:
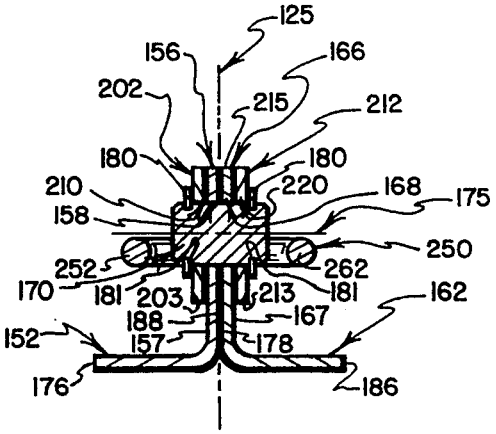
FIGS. 13, 14 and 15 are sectional views as seen from planes that are indicated by lines 13—13, 14—14 and 15—15 in FIG. 10, respectively.
Figure 14:
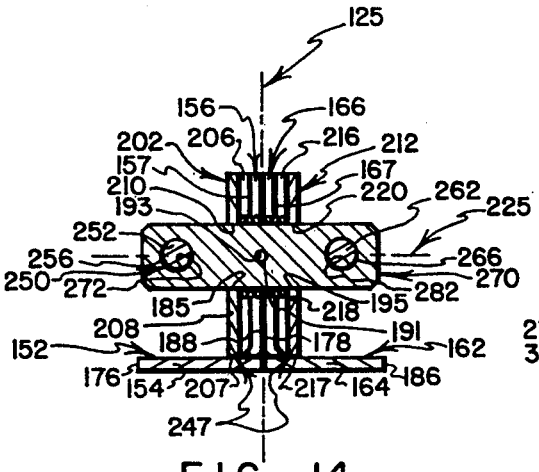
Figure 15:
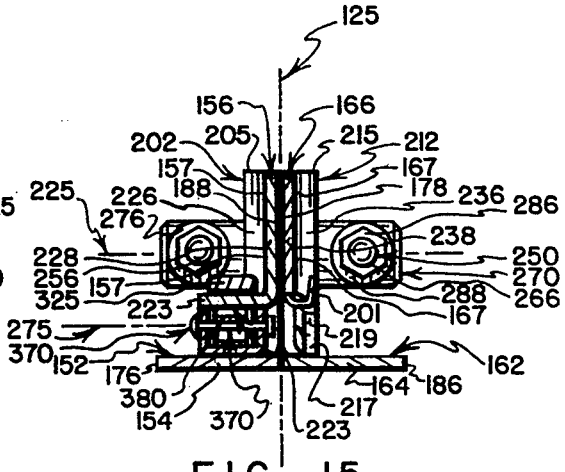

Referring to FIGS. 1, 4 and 12–15, the base 150 includes "front" and "rear" members 152, 162 that have flat bottom portions 154, 164 that extend contiguously, side by side in a common plane atop the mounting surface 20. The front and rear base members 152,162 have upwardly turned flange portions 156, 166 that extend in juxtaposed, side-by-side engagement. Referring to FIGS. 4 and 13, aligned holes 158, 168 are formed through the upturned flanges 156, 166 to receive a first pivot pin 170 in a slip fit. The holes 158, 168 extend coaxially about the pivot axis 175 whereby, when the pivot pin 170 is positioned in the aligned holes 158, 168, the pivot pin 170 extends coaxially about the pivot axis 175.

Referring to FIGS. 1–4 and 14–15, the front and rear base members 152, 162 have "left" end surfaces 172, 182, and have "right" end surfaces 174, 184 (wherein the designations of "left" and "right" are correct as regards what is depicted in FIGS. 1 and 3–11, but must be "reversed" when looking at the rear side elevational view that comprises FIG. 2). Referring principally to FIG. 4, the front base member 152 has a front edge surface 176, and a centerline surface 178 (that is partially defined by the rear face of the upstanding flange portion 156) that extends along the center plane 125. Similarly, the rear base member 162 has a rear edge surface 188, and a centerline surface 186 (that is partially defined by the front face of the upstanding flange portion 166) that extends along the center plane 125.

To mount the base members 152,162 atop the surface 20 of the underlying-member 30, suitable holes (not shown) can be drilled through the bottom portions 154, 164 to receive suitable fasteners such as bolts (not shown). Alternatively, the base members 152, 162 can be welded in place as by utilizing conventional welding techniques. While no connection is shown between the base members 152, 162 themselves (other than the presence of the pivot pin 170 which extends through the aligned holes 158,168 as is depicted in FIG. 13), the abuttingly engaging surfaces 178, 188 of the upwardly turned flange portions 156, 166 can be welded or otherwise suitably connected, as can other portions of the abutting centerline surfaces 178, 188.

Figure 1:
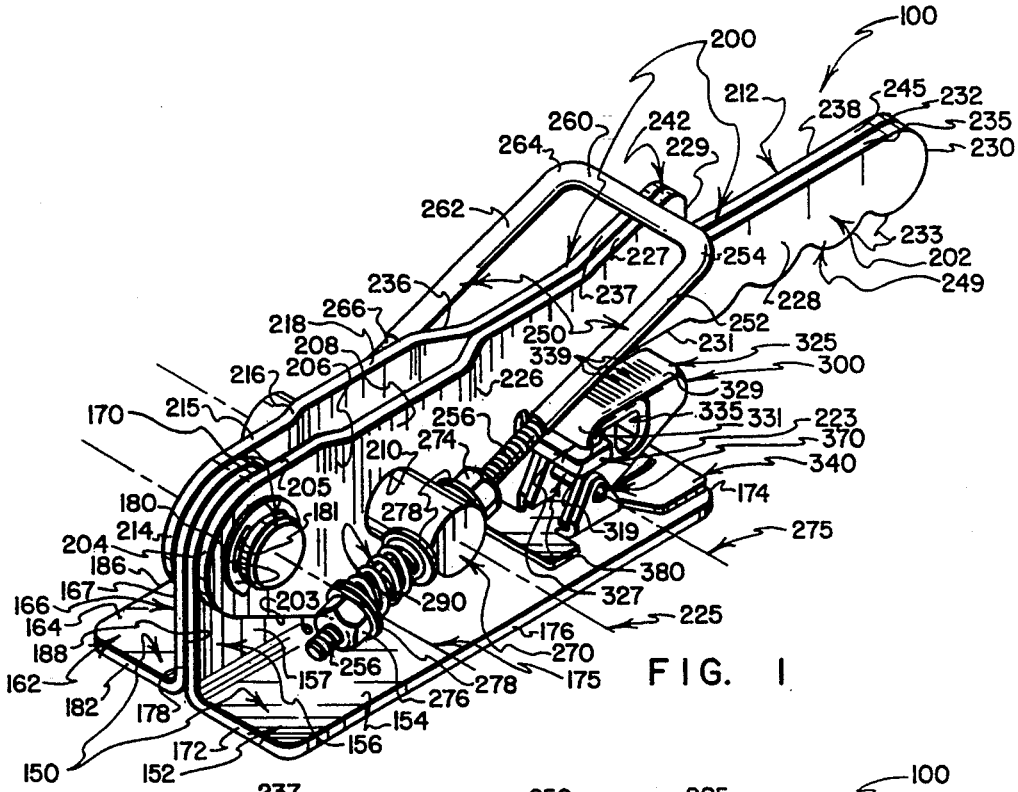
FIG. 1 is a perspective view of a first embodiment of a handle operated, toggle type draw latch that embodies one form of preferred practice of the present invention, with the view showing a handle of the latch assembly in its closed position, showing a drawbar of the latch assembly in its retracted position, showing one of two drawbar-mounted compression coil springs in a normal state of minimal compression, and showing a safety catch in its normal, non-operated position.

Referring to FIGS. 1, 3 and 4, the handle 200 is an elongate structure that is formed as an assembly of elongate front and rear members 202, 212 that are, for the most part, substantially identical except that the front member 202 is a mirror image of the rear member 212, and vice versa. Actually, the front handle member 202 does differ slightly from being a true mirror image of the rear handle member 212 in that the front handle member 202 defines a formation that is not present on the rear handle member 212, namely a forwardly-extending catch-engagement formation 223 that is located about mid-way along the length of the front handle member 202.

While the handle 200 of the first latch embodiment 100 (and the identical "200" style handle 1200 of the second latch embodiment 1100) has front and rear members 202, 212 that are designed to be rigidly interconnected solely by welding, the handle 2200 of the third latch embodiment 2100 (and the identical "2200" style handles 3200 and 4200 of the fourth and fifth latch embodiments 3100 and 4100, respectively) has aligned holes 2801, 2803 formed through the members 2202, 2212 (see FIG. 27) to receive rivets 2802, 2804, respectively. The rivets 2802, 2804 serve to rigidly interconnect the handle members 2202, 2212.

Referring principally to FIG. 4, the front and rear handle members 202,212 have rounded left end regions 204, 214 and rounded right end regions 230, 232, respectively. When the handle portions 228, 238 of the front and rear handle members 202, 212 are brought together so that their similarly configured features extend substantially congruently to form the handle 200, a handgrip 249 is defined by the right end region of the assembled handle 200. Defining opposite front and rear sides of the handgrip 249 are a front face of the front handle member 202 and a rear face of the rear handle member 212. Bordering the front and rear faces 202, 212 in the region of the handgrip 249 are a) contiguously extending wave-form bottom surfaces 233,243 of the front and rear handle members 202, 212, b) contiguously extending curved end surfaces 230, 232 of the front and rear handle members 202, 212, and c) contiguously extending flat top surfaces 235, 245 of the front and rear handle members 202, 212. Referring to FIGS. 2, 5–9 and 11, the bottom surfaces 233, 243 and the top surfaces 235, 245 extend generally along opposite sides of an imaginary centerline 375 of the handgrip 249. The centerline 375 parallels the top surfaces 235, 245 and centrally intersects the curved end surfaces 230,232.

Also formed by the rigidly interconnected portions 228, 238 of the front and rear handle members 202, 204, and extending along the top surface of the handle 200 is a generally triangular shaped stop formation that is indicated generally by the numeral 242. Defining opposite front and rear sides of the stop formation are the front face of the front handle member 202 and the rear face of the rear handle member 212. Bordering the front and rear faces of the handle members 202, 212 in the region of the triangular shaped stop formation 242 are contiguously extending flat bottom surfaces 231, 241 of the front and rear handle members, b) contiguously extending flat top surface portions 205, 215 that join with contiguously extending inclined flat top surface portions 227, 237, and c) flat rightly-facing surfaces 229, 239 that are connected by smoothly rounded "corners" to the inclined surface portions 227,237 and to the flat top surfaces 235,245 of the handgrip 249.

Other features of the front and rear handle members 202, 212 will be described beginning generally from the vicinities of the rounded left end regions 204, 214 and extending rightwardly along the length of the handle members 202, 212.

Referring to FIGS. 3 and 10, the rounded left end regions 204, 214 are spaced equally from the center plane 125 sufficiently to extend in a yoke-like manner along forwardly and rearwardly facing surfaces 157,167 of the abuttingly engaged upstanding flange portions 156, 166 of the front and rear base members 152, 162, respectively.

Referring to FIG. 4, extending rightwardly from the left end region 204 of the front handle member 202 is a forwardly angled portion 206 that forms a transition between the end region 204 and a flat portion 208 of the front handle member 202 that parallels the center plane 125 but at a greater distance therefrom than does the left end region 204. In like manner, extending rightwardly from the left end region 214 of the rear handle member 212 is a rearwardly angled portion 216 that forms a transition between the end region 214 and a flat portion 218 that parallels the center plane 125. Forming transitions between the handle portions 208, 218 and the handle portions 228, 238 are angled portions 226, 236 of the handle members 202, 212, respectively.

Extending rightwardly from the rounded left end regions 204, 214 and defining lengthy top surface reaches of the handle members 202, 212 are the flat top surfaces 205, 215 that join eventually with the upwardly inclined surfaces 227,237 of the stop formation 242.

Extending rightwardly from the rounded left end regions 204, 214 of the handle members 202, 212 are flat bottom surfaces 203, 213. The flat bottom surfaces 203, 213 underlie the angled transition portions 206, 216 and join smoothly with rounded bottom surface formations 207, 217 that underlie the widely spaced formations 208, 218. At their lowest point, the rounded bottom formations 207, 217 cooperate to define a stop 247 (i.e., the side-by-side formations bottom surfaces 207, 217 act, in unison, to cooperatively define the stop 247) that engages the base members 152, 162 when the handle 200 is in its "closed" position, as is depicted in FIGS. 1–3 and 9–11, and as is shown in the sectional view of FIG. 14.

The rounded bottom surface formations 207, 217 that define the stop formation 247 join with upwardly curved, rightwardly extending bottom surface portions 209, 219 that also underlie the widely spaced formations 208, 218. The curved surfaces 209,219 join with flat surface portions 211,221 that underlie the regions 226, 236.

Referring to FIG. 4, the flat surface 211 of the front handle member 202 extends rightwardly to a point where the bottom surface of the handle is cut away adjacent the provision of the forwardly extending, generally flat, catch-engaging formation 223. From the right side of the catch-engaging formation 223, the flat bottom surface 231 that underlies the stop formation 242 extends rightwardly to join with the wave-form bottom surface 233 that forms a part of the handle grip 249. Likewise, the rear handle member 212 has a bottom surface 241 that is partially defined by the flat bottom surface portion 233 that underlies the stop formation 242 and joins with the wave-form bottom surface 243.

Figure 11:
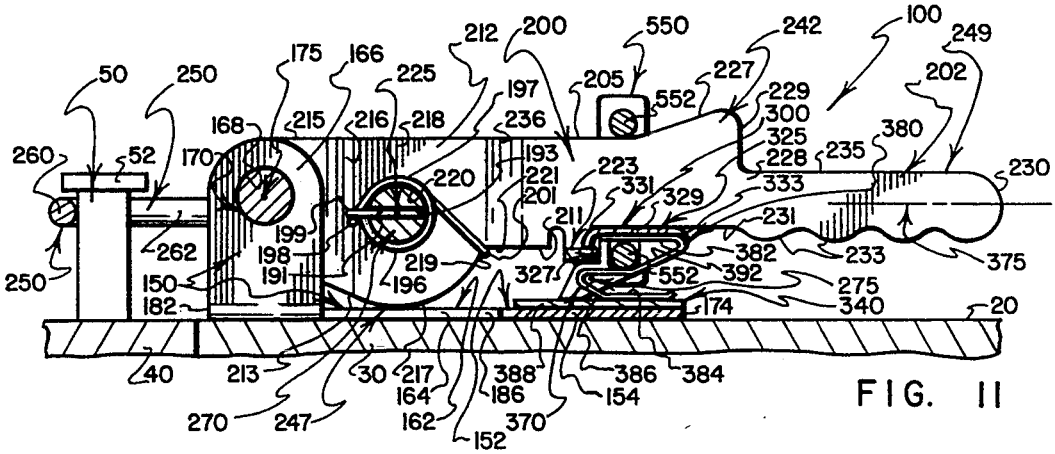
FIG. 11 is a sectional view as seen from planes that are indicated by the broken line 11—11 in FIG. 10.
Figure 12:
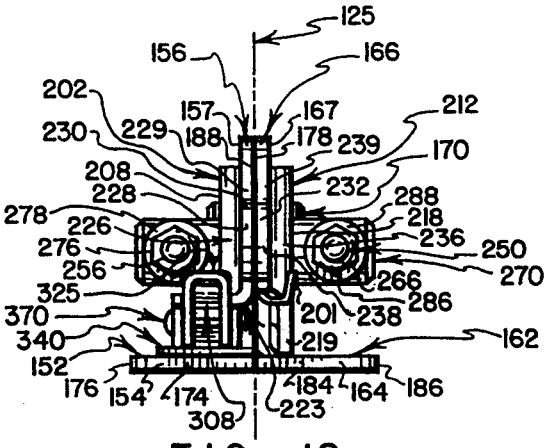
FIG. 12 is a right end elevational view of the mounted latch assembly with the components thereof positioned as is depicted in FIGS. 10 and 11.

Also depicted in FIG. 4, but in phantom, are a depending formation 502 that optionally can be provided as an integral depending portion of the front handle member 202, and an upwardly extending formation 504 that optionally can be provided as an integral upwardly extending portion of the rear base member 162. If the formations 502, 504 are provided in the manner that is depicted in phantom in FIG. 4, the apertures 512, 514 that they respectively define will align (when the handle 200 is latched closed by the safety catch 300, as will be described in greater detail shortly) to receive the shackle 552 of a padlock 550 that can be installed on the latch assembly 100 to lock the safety catch 300 in its latched position, and to lock the handle 200 to the base 150, as is depicted in FIGS. 10 and 11. While it will be understood that optional formations that correspond to the formations 502, 504 can be included when the latch embodiments 1100, 2100, 3100, 4100 are manufactured, such corresponding formations are not depicted in the drawings.

Aligned holes 210, 220 (see FIGS. 4 and 13) are formed through the rounded left end regions 204, 214 of the front and rear handle members 202, 212, respectively. The aligned holes 210, 220 extend coaxially about the first pivot axis 175, receive the first pivot pin 170 in a slip fit, and orient the first pivot pin 170 to extend coaxially along the first pivot axis 175. Spring retainer clips 180 engage grooves 181 that are formed in opposite end regions of the first pivot pin 170 and extend along a front face of the front handle member 202 and along a rear face of the rear handle member 212 to secure the first pivot pin 170 in place.

While the front and rear handle members 202, 212 that form the "200" style handle (that is utilized by the first and second latch embodiments 100, 1100) are configured quite like the front and rear handle members 2202, 2212 that form the "2200" style handle (that is utilized by the third, fourth and fifth latch embodiments 2100, 3100, 4100), there are differences between the "200" style of handle and the "2200" style of handle. Referring to FIG. 4 (wherein the front and rear handle members 202, 212 of the handle 200 are depicted) and to FIG. 27 (wherein the front and rear handle members 2202, 2212 of the handle 2200 are depicted), it will be seen that, while the handle members 202, 212 have aligned holes 185, 195 that are sized to closely receive their associated second pivot pin 270 to form a substantially "play free" connection therebetween (i.e., a so-called "slip fit"), the handle members 2202, 2212 have aligned holes 2185, 2195 that are "over-sized" to quite loosely receive uniform diameter end regions 2901, 2911 of their associated second pivot pin 2270.

Figure 27:
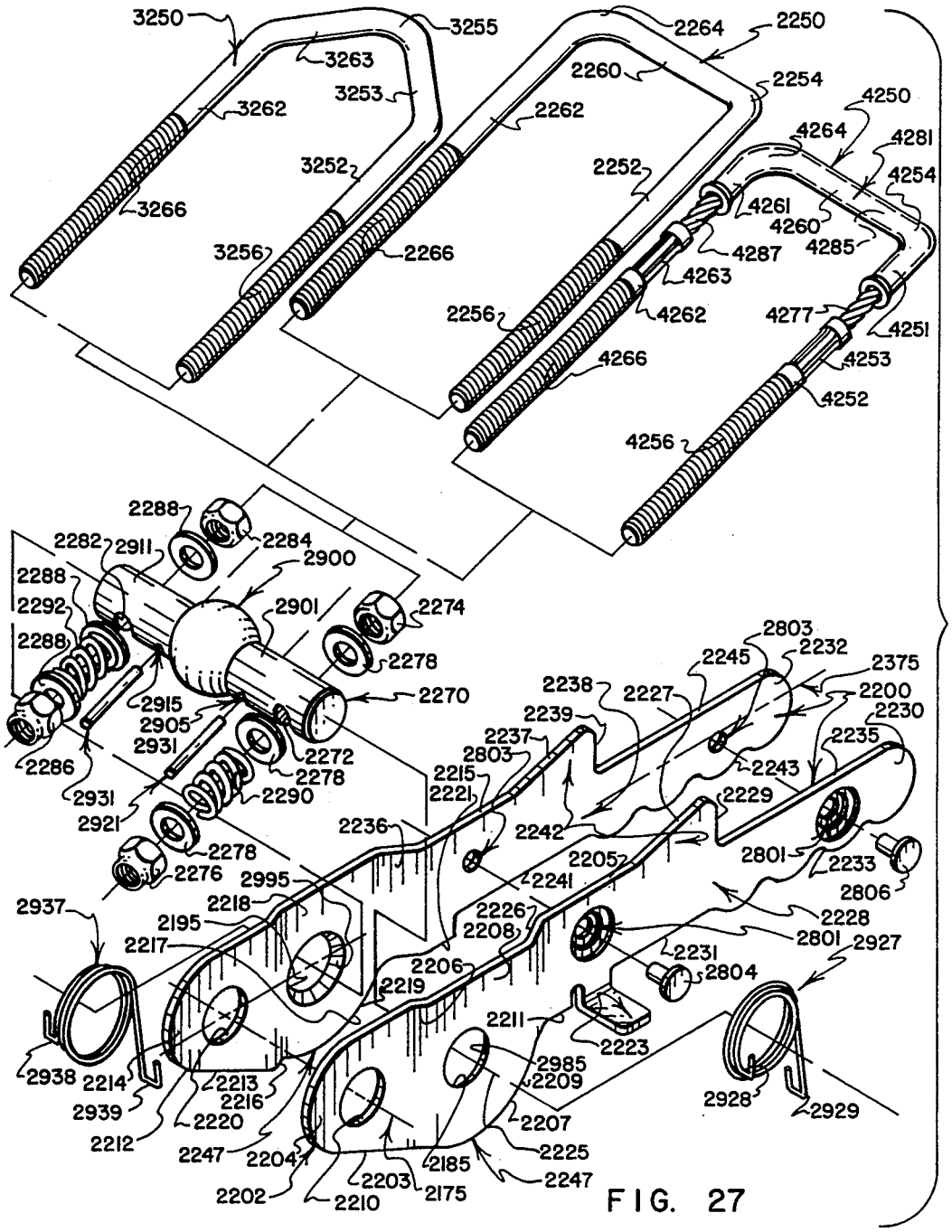

While the holes 2185, 2195 are "over-sized" so as to loosely receive the uniform diameter end regions 2901, 2911, the holes 2185, 2195 are not so large in diameter as to permit an enlarged spherical formation 2900 of the pin 2270 to pass therethrough—whereby the spherical formation 2900 is caused to be confined between the handle members 2202, 2212. Referring to FIG. 27, the holes 2185, 2195 are chamfered to define substantially frusto-conical shaped bearing surfaces 2985, 2995 that are configured to matingly engage opposite side portions of the spherical formation 2900 to provide, in essence, a "ball joint" type of connection between the handle 2200 and the second pivot pin 2270. This "spherical" or "ball joint" type of connection that couples the pivot pin 2270 to the handle 2200 provides plural degrees of freedom of relative movement—whereby limited movement of the second pivot pin 2270 is permitted to take place relative to the handle 2200 in substantially any chosen direction about an imaginary center point that is located along the axis 2225 at a position that is centered within the spherical formation 2900 (see FIGS. 18–20 wherein such a center point is indicated by the numeral 2925).

The "plural degrees of freedom of relative movement" that are afforded by the "spherical" or "ball joint" connection that is formed between the handle 2200 and the second pivot pin 2270 is unlike the "single degree of freedom of relative movement" that is afforded by the much simpler "axial rotation" type of connection that is formed between the handle 200 and the second pivot pin 270 of the latch embodiment 100. The constant diameter holes 185, 195 receive the constant diameter pin 270 in a slip fit, and limit movement of the second pivot pin 270 relative to the handle 200 to simple rotation about the common axis 225 of the holes 185,195 and of the second pivot pin 270.

An advantage afforded by the "spherical" or "ball joint" type of connection that is formed between the second pivot pin 2270 and- the handle 2200 of the third latch embodiment 2100 (which type of connection also is employed in the third and fourth latch embodiments 3100, 4100), is to permit a drawbar 2250 (that is connected to opposite end regions 2901, 2911 of the second pivot pin 2270) to tilt forwardly and rearwardly with respect to the center plane 2125 of the latch 2100 to engage a post formation 2050 that is not aligned with the center plane 2125. To illustrate this feature, reference is made to FIG. 20 wherein rearward tilting of the drawbar 2250 to engage a post formation 2050 that is positioned rearwardly with respect to the center plane 2125 is depicted in solid lines, and wherein forward tilting of the drawbar 2250 to engage a post formation 2050 that is positioned forwardly with respect to the center plane 2125 is depicted in phantom (see also FIGS. 23 and 26 wherein similar solid-line and phantom depictions of drawbars 3250, 4250 and of nonaligned post formations 3050, 4050 are presented to illustrate how this feature applies to the third and fourth latch embodiments 3100, 4100, respectively).

Another difference between the "200" and "2200" handle styles has to do with the manner in which their associated second pivot pins 270, 2270 are constrained from moving axially (i.e., constrained from moving "transversely" in forward and rearward directions relative to the handles 200, 2200). With the "2200" style of handle, the bearing surfaces 2985, 2995 of the front and rear handle members 2202, 2212 engage the spherical formation 2900 to provide a "ball joint" type of connection between the second pivot pin 2270 and the handle 2200 that keeps the second pivot pin 2270 "centered" with respect to the handle 2200 whereby axial (i.e., "transverse") movement of the second pivot pin 2270 relative to the handle 2200 is prevented.

Because the "200" style of handle has no "enlarged spherical formation" located mid-way along the length of its associated second pivot pin 270 that can be confined by its handle members 202,212 to keep the second pivot pin 270 "centered" with respect to the handle 200, a different approach is taken. Referring to FIGS. 4 and 11, a coil-formed pin 191 is driven part way into a hole 193 that is formed diametrically through the second pivot pin 270 at a location that extends within the center plane 125 (i.e., at a location that is mid-way along the length of the second pivot pin 270). A torsion coil spring 197 has a central portion 198 that connects with a projecting end region 199 of the coil-formed pin 191. The torsion coil spring 197 also has front and rear coils 194, 196 that are located on opposite sides of the pin 191 and that are interposed between the pin 191 and the front and rear handle members 202,212, respectively. The front and rear coils 194, 196 thus serve in one capacity as "spacers" that keep the coil-formed pin 191 "centered" between the front and rear handle members 202,212—and thereby also serve to keep the second pivot pin 270 "centered" relative to the handle 200.

Another function provided by the torsion coil spring 197 is to bias the second pivot pin 270 clockwise relative to the handle 200 (i.e., "clockwise when the latch 100 is viewed in front side elevation, as in FIGS. 5–9) to bias the drawbar 250 toward its retracted position (the drawbar 250 is depicted in its retracted position in FIGS. 1–3 and 5). Opposed, hook-shaped end regions 201 of the torsion coil spring 197 engage flat bottom surface portions 211,221 of the handle members 202,212 (at locations where the flat bottom surface portions 211,221 join the curved surface portions 209, 219) and cooperate with the spring's central portion 198 (which engages the projecting end region 199 of the coil-formed pin 191) to permit the front and rear coils 194,196 to effect "clockwise" biasing of the drawbar 250 toward its retracted position. When the drawbar 250 is in its retracted position, a crossbar 260 of the drawbar 250 engages the inclined surfaces 227, 237 of the stop formation 242, as is depicted in solid lines in FIGS. 1–3 and 5–7, and in phantom in FIGS. 6 and 7.

The "2200" style handle does not utilize a single torsion coil spring and a single coil-formed pin that are situated between its handle members 2202, 2212 to bias its second pivot pin 2270 "clockwise" (i.e., to bias its drawbar 2250 toward its retracted position, as has been described above in conjunction with the biasing of the drawbar 250 of the latch 100). Rather, a pair of torsion coil springs 2927, 2937 and a pair of coil-formed pins 2921, 2931 (see FIG. 27) are connected to the constant diameter end regions 2901, 2911 of the second pivot pin 2270—with the spring 2927 and the pin 2921 being situated forwardly along the pivot axis 2225 with respect to the front handle member 2202, and with the spring 2937 and the pin 2931 being situated rearwardly along the pivot axis 2225 with respect to the rear handle member 2202.

The coil-formed pins 2921, 2931 are driven part way into holes 2905, 2915 that are formed diametrically through the constant diameter end regions 2901, 2915, respectively, of the second pivot pin 2270. The springs 2927, 2937 have hook-shaped end region 2928, 2938 that connect with the pins 2921, 2931, and have hook-shaped end regions 2929, 2939 that engage the bottom surface portions of the handle members 2202, 2212. By this arrangement, the torsion coil springs 2927, 2937 serve the function of biasing the drawbar 2250 about the axis 2225 away from extended positions (see the solid-line extended-position depiction of the drawbar 2250 in FIGS. 18 and 19) toward the drawbar's retracted position (see the phantom-line depiction of the drawbar 2250 in FIGS. 18 and 19).

Referring principally to FIG. 4, the drawbar 250 is a U-shaped structure that has front and rear leg portions 252,262 that are interconnected by a transversely extending cross-leg 260. Rounded bends 254, 264 are provided where the front and rear leg portions 252, 262 join with the cross-leg 260. Threaded end regions 256, 266 are defined by the front and rear leg portions 252, 262, respectively. The threaded end regions 256, 266 extend through holes 272, 282 that are formed through the second pivot pin 270 (see FIG. 14). Tightly fitting nuts 274, 284 and locknuts 276, 286 are threaded onto the threaded end regions 256, 266 at locations on opposite sides of the holes 272,282 that extend through the second pivot pin 270.

While the second and third latch embodiments 1100, 2100 utilize drawbars 1250, 2250 that are identical to the drawbar 250, the fourth and fifth latch embodiments 3100, 4100 utilize differently configured drawbars 3250, 4250. Referring to FIGS. 21–23 and 27, the drawbar 3250 is a generally V-shaped structure that has front and rear leg portions 3252, 3262 that are bent midway along their lengths to provide leg portions 3253, 3263 that angle toward each other and interconnect to form a V-shaped juncture 3255.

Referring to FIGS. 24–26 and 27, the drawbar 4250 is a U-shaped structure that differs from the U-shaped drawbar 250 in that the drawbar 4250 is not entirely rigid. The drawbar 4250 has three rigid components, and two flexible components. The rigid components include front and rear leg portions 4252, 4262 (located adjacent to and formed integrally with the threaded end regions 4256, 4266), and a tubular U-shaped member 4281 that defines a cross-leg 4260, front and rear leg portions 4251, 4261, and rounded corner regions 4254, 4264 of the drawbar 4250.

The two flexible components of the drawbar 4250 are defined by two exposed lengths 4277, 4287 of a steel cable 4285 (i.e., a cable that is formed by weaving steel strands to form what often is referred to as "wire rope"). The exposed lengths of cable 4277, 4287 are spaced portions of a single length of cable 4285 that extends through the rigid tubular member 4281. The type of steel cable selected for this use is relatively stiff but exhibits sufficiently flexibility to permit the rigid U-shaped tubular member 4281 to be moved out of a plane in which the rigid front and rear leg portions 4254, 4264 extend—whereby the drawbar 4250 is given a characteristic bit of flexibility.

To manufacture the drawbar 4250, the cable 4285 is threaded through the tubular member 4281 at a time before the tubular member 4281 is deformed by bending to take on its U-shaped configuration. The bending of the tubular member 4281 is effected in a manner that causes the tubular member 4281 to grip the cable 4285 so that, when the bending of the tubular member 4281 is complete, the cable 4285 is rigidly connected to the tubular member 4281. Opposite end regions of the cable 4285 are rigidly connected to the front and rear leg portions 4252, 4262 by conventional crimp-type cable connectors 4253, 4263.

While the drawbars 3250, 4250 are depicted in the drawings as being used only with "2200" style handles, the drawbars 250, 1250, 2250, 3250, 4250 can be interchangeably mounted on any of the latch embodiments 100, 1100, 2100, 3100, 4100—as the needs of a particular application may dictate. Drawbar interchangeability is one of the ways in which latches that embody the preferred practice of the present invention exhibit a high degree of versatility.

Carried on the threaded end regions 256, 266 of the drawbar 250 of the first latch embodiment 100 are several components—identical quantities of which are utilized by the drawbars 2250, 3250, 4250 of the third, fourth and fifth latch embodiments 2100, 3100, 4100, but with lesser quantities of some of these components being required by the drawbar 1250 of the second latch embodiment 1100. For example, the latch 100 has three washers 278 and three washers 288 positioned on the threaded end regions 256, 266, while the latch 1100 has only two of the washers 1278 and two of the washers 1288 positioned on its threaded end regions 1256, 1266. While two compression coil springs 290,292 are interposed (together with two of the washers 278, 288) between the locknuts 276,286 on the threaded end regions 256, 266 of the latch 100, no compression coil springs at all are installed on the threaded end regions 1256, 1266 of the latch 1100.

The purpose for providing the threaded end regions 256, 266 and the nuts 274, 284 and 276, 286 is to permit the "effective length" of the crossbar 250 (i.e., the distance between the crossleg 260 of the drawbar 250 and the pivot axis 225 of the second pivot pin 270) to be adjusted as may be needed to permit the latch assembly 100 to properly engage and apply force to the latch-engageable formation 50. Because the tight fitting nuts 274,284 and the locknuts 276, 286 can be adjusted along the threaded end regions 256, 266, the line of engagement along which the crossleg 260 of the drawbar 250 engage the inclined surfaces 227,237 of the stop formation 242 will vary when the drawbar 250 is retracted as is depicted in FIGS. 1–3 and 5. However, the length and location of the inclined surfaces 227, 237 is sufficient to assure that the crossbar 260 will not extend beyond the upstanding end surfaces 229, 239 of the stop formation 242 but rather will always engage the inclined surfaces 227,237—and will therefor always be prevented from engaging the handgrip formation 249 that is provided near the right end regions 230 of the handle 200. The same applies to the drawbars 1250, 2250, 3250, 4250 of the latch embodiments 1100, 2100, 3100, 4100—namely that their drawbars 1250, 2250, 3250, 4250 will engage their inclined stop formations 1242, 2242, 3242, 4442 when the drawbars 1250, 2250, 3250, 4250 are in their retracted positions.

The compression coil springs 290, 292 give the latch assembly 100 an ability to self-adjust and to apply a suitable drawing force to the latch-engageable formation 50. The same is true with respect to corresponding coil springs 2290, 2292; 3290, 3292; and 4290, 4292 of the latch embodiments 2100, 3100, 4100. This is in contrast with the latch assembly 1100 which utilizes no corresponding springs and therefore does not self-adjust but rather operates in a way that relies on the proper adjustment of the nuts 1274, 1276 and 1284, 1286 to position the drawbar 1250 relative to the second pivot pin 1270.

While the drawbars 2250, 3250, 4250 are depicted in the drawings as carrying compression coil springs (in the manner that has been described in conjunction with the first latch embodiment 100), it will be understood that the drawbars 2250, 3250, 4250 can be utilized (in the manner that has been described in conjunction with the second latch embodiment 1100) without having compression coil springs installed thereon.

Referring to FIGS. 1–12 and 15, the safety catch 300 includes the mounting bracket 340, the pivotally movable catch member 325, the pivot pin 370 that mounts the catch member 325 on the bracket 340 for pivotal movement about the third pivot axis 275, and a generally Z-shaped leaf spring 380.

Referring to FIG. 4, the mounting bracket 340 has a generally H-shaped bottom structure 342 that is welded to the front base member 152. The location of the bracket 340 atop the bottom portion 154 of the front base member 152 is selected to position front and rear upwardly turned arm portions 345, 347 of the bracket 340 so that aligned holes 344, 346 that are formed through the arm portions 345, 347 to mount the pivot pin 370 position the pivot pin 370 and its pivot axis 275 directly beneath the position that is occupied by the catch-engagement formation 223 when the handle 200 is in its closed position (for example as is depicted in FIGS. 1–3, 5 and 9–12).

Referring to FIG. 4, the pivotally mounted catch member 325 has a top wall 329 that has a smoothly curved, downwardly extending left end region 331, and a smoothly rounded right end region 333. The catch member 325 has a pair of generally triangular shaped front and rear arm portions 335,337 that depend from smoothly rounded junctures with the top wall 329 to extend in juxtaposed relationship with the upwardly turned arm portions 345, 347 of the mounting bracket 340. Aligned holes 334, 336 are formed through the arm portions 335, 337, through which the pivot pin 370 is received in a slip fit to pivotally mount the catch member 325 on the mounting bracket 340.

Figure 5:
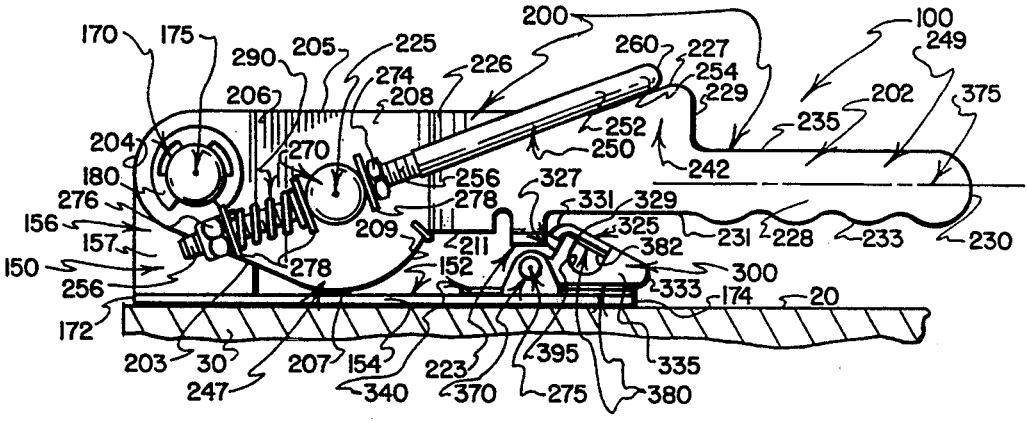
FIG. 5 is a front side elevational view of the latch assembly shown mounted on a surface that is defined by a member that extends beneath the latch assembly, with the handle shown in its closed position, with the drawbar shown in its retracted position, with one of the drawbar-mounted compression coil springs shown minimally compressed, and with the safety catch shown pivoted to an operated position.

Referring to FIG. 4, the top surface of the top wall 329 of the pivotally mounted catch member 325 is provided with a series of upwardly-facing thumb-grip indentations 339 that help to retain one's thumb in place atop the catch member 325 for operating the catch member 325 by depressing the right end region 333 of the catch member 325 to pivot the catch member 325 about the third pivot axis 370 to the unlatched position that is depicted in FIG. 5.

Figure 9:
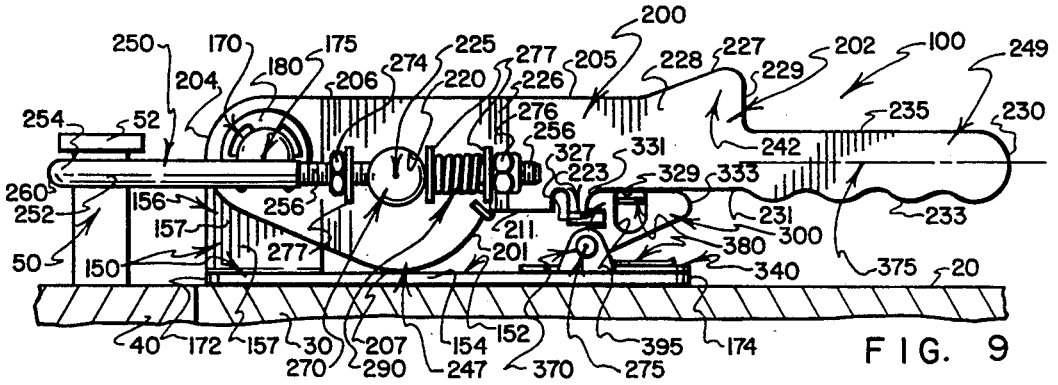
FIG. 9 is a front side elevational view of the mounted latch assembly and mounted latch-engageable post formation, with the members on which the latch assembly and the latch-engageable post formation having been drawn together as the two members on which the latch assembly and the post formation were joined by operating the latch assembly, with the handle shown in its closed position, with the drawbar shown embracing the latch-engageable post formation, with one of the drawbar-mounted compression coil springs shown compressed, and with the safety catch shown in its normal, non-operated position wherein (when the handle is closed as is depicted) the safety catch functions to releasably retain the handle in its closed position.

The latching notch 327 of the catch member 325 is defined in part by aligned notches 315, 317 that are formed in the depending front and rear arm portions 335, 337, and by a downwardly-facing surface 319 of the downwardly turned left end region 331 of the top wall 329. When the latching notch 327 of the catch member 325 receives the catch-engagement formation 223 of the handle 200 (as is best seen in FIGS. 1, 9 and 11), the handle 200 is said to be "latched closed" inasmuch as the handle 200 is prevented thereby from pivoting out of its closed position until the catch member 325 is pivoted to its unlatched position (as is depicted in FIG. 5).

Figure 8:
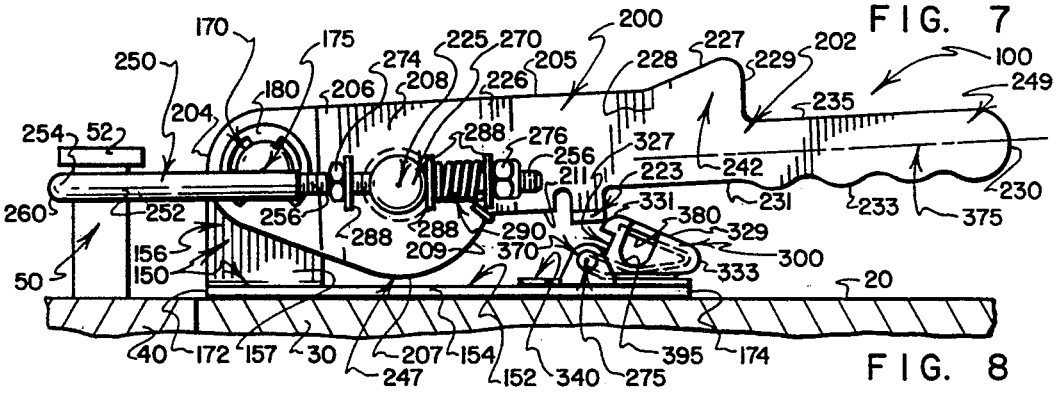
FIG. 8 is a front side elevational view of the mounted latch assembly and mounted latch-engageable post formation, with the members on which the latch assembly and the latch-engageable post formation are mounted having been drawn together as the handle was pivoted from the open position that is depicted in FIG. 7 to the nearly closed position that is depicted in FIG. 8, with the drawbar shown embracing the latch-engageable post formation, with one of the drawbar-mounted compression coil springs shown compressed by the drawbar's having been extended relative to the handle during the drawing together of the two members on which the latch assembly and post formation are mounted, and with the safety catch in the process of being cammed toward its operated position by a cam-engageable formation that is carried by the handle.

Referring to FIG. 8, a feature of the catch member 325 is that the rounded left end region 331 of the top wall 329 is configured to be engaged by the catch-engagement formation 223 during movement of the handle 200 toward its closed position. As the handle 200 is pivoted progressively toward its closed position, the handle-carried catch-engagement formation 223 progressively cams the base-carried catch member 325 to pivot the catch member 325 in opposition to the biasing action of the leaf spring 380. As the catch member 325 is progressively caused to pivot away from its latched position toward its unlatched position, the latch-engagement formation 223 slides progressively along the rounded left end region 331 of the top wall 329 of the catch member 325. The sliding of the latch-engagement formation 223 along the rounded left end region 331 continues until the formation 223 drops beneath the end surface 319 of rounded left end 331 and into the latching notch 327, whereupon the handle 220 attains its closed position as the biasing action of the leaf spring 380 snaps the pivotally mounted catch member 325 back to its latched position—whereby the latch-engagement formation 223 is received within the latching notch 327 of the safety catch 300 (i.e., the handle 200 is "latched closed").

The Z-shaped leaf spring 380 has a relatively flat upper reach 382 that underlies the top wall 329 of the pivotally mounted catch member 325 and biases the pivotally mounted catch member 325 toward a latched position that is depicted in FIGS. 1–3, 6, 7, 9–12 and 15. The leaf spring 380 has a relatively flat lower reach 384 that rests atop portions of the mounting bracket 340; an upwardly inclined left portion 386 that extends between the left end of the lower reach 384 and a smoothly rounded bend 388; a flat central reach 390 that extends rightwardly from the bend 388; and an upwardly inclined right portion 392 that extends between the right end of the center reach 390 and a bend 394 that joins with the right end of the upper reach 382.

Referring to FIG. 11, the curved bend 388 extends about portions of the pivot pin 370 to prevent unwanted rightward movement of the leaf spring 380. Unwanted leftward movement of the leaf spring 380 is prevented by the left end region of the upper reach 382 extending adjacent the downwardly turned end region 331 of the top wall 329. Thus, the generally Z-shaped leaf spring 380 tends to be held in place once it has been interposed as described between the mounting bracket 340 and the pivotally mounted catch member 325.

A feature of the pivotally mounted catch member 325 is that its downwardly turned front and rear arms 335, 337 have relatively large aligned apertures 395, 397 (although the aperture 395 is easily discerned in FIG. 4 and other views, the aperture 397 is best seen in FIG. 2) formed therethrough at a location just beneath the top wall 329 for receiving the shackle 552 of a padlock 550 that can be installed on the latch assembly 100, as is depicted in FIGS. 10 and 11. Because the safety catch assembly 300 is securely connected to the front base member 152, the effect of installing the padlock shackle 552 through the aligned apertures 395, 397 in a manner that also embraces portions of the handle 200 (as shown in FIGS. 10 and 11) is a) to secure the safety catch 300 (i.e., to prevent the catch member 325 from pivoting away from its latched position toward its unlatched position), and b) to concomitantly lock the handle 200 to the base 150. If desired, the formations 502, 504 that are depicted in phantom in FIG. 4 can be provided as integral parts of the front handle member 202 and the rear base member 162 for positioning their apertures 512, 514 in alignment with the apertures 395, 397 to also receive the padlock shackle 552 and to enhance the strength of the secure connection that is provided between the handle 202 and the base 150 when the padlock 550 is installed on the latch assembly 100 in the manner that is depicted in FIGS. 10 and 11.

The remaining portion of this description is principally devoted to an explanation of a typical manner in which the latches 100, 1100, 2100, 3100, 4100 are put to use. While the operational description that follows refers principally to the latch embodiment 100, it will be understood that the description is equally applicable to latch embodiments 1100, 2100, 3100, 4100.

In operation, the various components of the latch assembly 100 normally assume the positions depicted in FIG. 1 when the latch assembly 100 is not being used to engage the latch-engagement formation 50. In the positions depicted in FIG. 1, the handle 200 is latched closed by the safety catch 300, and the drawbar 250 is held in its retracted position (with its crossleg 260 engaging the stop formation 242 of the handle 200) by the action of the torsion coil spring 197.

Figure 6:
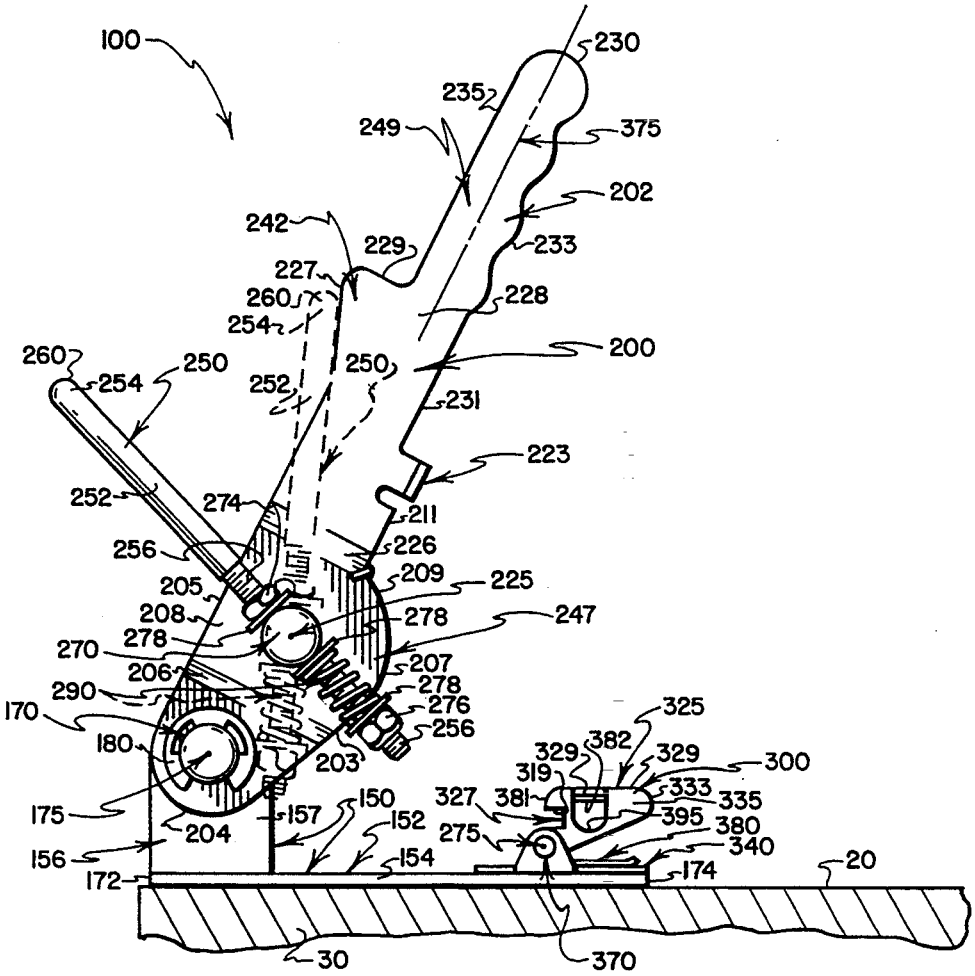
FIG. 6 is a front side elevational view of the mounted latch assembly but with the handle shown pivoted to one of many possible open positions, with the drawbar shown in solid lines as having been pivoted to one of many possible extended positions (and shown in phantom in a retracted position), with one of the drawbar-mounted compression coil springs shown minimally compressed, and with the safety catch shown in its normal, non-operated position.

To move the drawbar 250 into embracing engagement with the latch-engagement formation 50, the safety catch 300 is operated (as is depicted in FIG. 5 to release the engagement of the latching notch 327 with the catch-engagement formation 223), and the handle 200 is pivoted about the first pivot axis 175 from its closed position to the open position shown in FIG. 6, and onward to the open position shown in FIG. 7. As the handle 200 is moved into the open position shown in FIG. 7, the drawbar 250 is pivoted relative to the handle 200 about the second pivot axis 225 to move the drawbar away from its retracted position toward extended positions that are shown in solid lines in FIGS. 6 and 7 to bring the drawbar 250 into embracing engagement with the post-like latch-engagement formation 50, as is depicted in FIG. 7.

With the drawbar 250 embracing the post-like latch-engagement formation 50, the handle 200 is pivoted about the first pivot axis 175 toward its closed position. As the handle 200 approaches its closed position, the catch-engagement formation 223 cams the pivotally mounted catch member 325 in opposition to the action of the leaf spring 380 away from its latched position toward its unlatched position, as is shown in FIG. 8. As the handle 200 reaches its closed position, the biasing action of the leaf spring 380 snaps the pivotally mounted catch member 325 into its latched position to bring its latching notch 327 into retaining engagement with the catch-engagement formation 223 of the handle.

To ensure that the drawbar 250 properly applies force to the latch-engagement formation 50 during closure movement of the handle 200, the lock nuts 274, 284 and 276, 286 may be adjusted along the threaded end regions 256, 266 of the drawbar 250, as needed. In the latch embodiment 100, the adjustment of the lock nuts 274, 284 and 276, 286 affects not only the "effective length" of the drawbar 250 but also the extent to which the drawbar-carried springs 290, 292 will be compressed as the handle 200 is pivoted to its closed position. Referring to FIGS. 16 and 17, if no compression coil springs are installed on the drawbar 1250, the adjustment of the lock nuts 1274, 1284 and 1276, 1286 affects only the "effective length" of the drawbar 1250.

While the invention has been described with a certain degree of particularity, it will be understood that the present disclosure of the preferred embodiment has been made only by way of example and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. In a toggle type draw latch assembly that has a base, an elongate operating handle pivotally connected to the base near one end region thereof for moving between an open position and a closed position wherein a portion of the handle is situated relatively near to the base, having a hand grip formed near the opposite end region thereof, having a drawbar pivotally connected to the handle at a location that is nearer to the one end region of the handle than to the hand grip, with the drawbar being pivotally movable relative to the handle between an extended position and a retracted position wherein a portion of the drawbar is situated relatively near to the hand grip, the improvement comprising:

a) means for adjusting the effective length of the drawbar within a given range of adjustment, with such adjustment affecting the nearness of the drawbar to the hand grip when the drawbar is in its retracted position;

b) first stop formation means connected to the handle for defining drawbar engaging surface means at a location near the hand grip for being engaged by the drawbar when the drawbar is in its retracted position;

c) with the drawbar engaging surface means including a surface that extends for a sufficient distance along the length of the handle at said location near the hand grip for being engaged by the drawbar when the drawbar is in its retracted position regardless of where within said given range of adjustment the means for adjusting the effective length of the drawbar is set; and, d) with the drawbar engaging surface being configured to ensure that the retracted position of the drawbar is held at a sufficiently far distance away from the location of the hand grip to ensure that, regardless of where within said given range of adjustment the means for adjusting the effective length of the drawbar is set, the retracted drawbar will not so closely approach the hand grip as to endanger portions of a hand that is gripping the hand grip being contacted by the retracted drawbar.

2. The toggle type draw latch assembly of claim 1 wherein the hand grip extends about an imaginary centerline that generally parallels the length of the elongate handle so as to extend through said one and opposite end regions of the handle, and the drawbar engaging surface is configured to extend progressively farther from said centerline the closer that it approaches the hand grip.

3. The toggle type draw latch assembly of claim 2 wherein the drawbar engaging surface is planar in character in that it extends substantially within a common plane that is inclined relative to said centerline so as to more closely approach the centerline as it extends away from the hand grip.

4. The toggle type draw latch assembly of claim 1 wherein the handle also defines second stop formation means connected to the handle for defining base engaging surface means at a location that is near the location where the drawbar is pivotally connected to the handle for engaging the base when the handle is pivoted to said closed position to define the closed position of the handle.

5. The toggle type draw latch assembly of claim 4 wherein the base engaging surface means presents a convexly curved surface that engages the base when the handle is in its closed position.

6. The toggle type draw latch assembly of claim 1 additionally including drawbar biasing means for biasing the drawbar to pivot relative to the handle toward its retracted position.

7. The toggle type draw latch assembly of claim 6 wherein 1) the handle has at least one hole formed therethrough 2) an elongate pivot pin has a central portion that extends through said at least one hole, 3) the elongate pivot pin is pivotally connected to the handle for movement relative to the handle about an imaginary pivot axis that extends centrally along the length of the elongate pivot pin, 4) the drawbar is connected to opposite end regions of the elongate pivot pin for pivotal movement therewith relative to the handle, and 5) said biasing means includes torsion coil springs interposed between the handle and the elongate pivot pin for biasing the drawbar toward its retracted position.

8. The toggle type draw latch assembly of claim 7 additionally including connection means for establishing a pivotal connection between the handle and the elongate pivot pin at a location near where the elongate pivot pin extends through said at least one hole, and for defining a pivotal connection of the type that limits relative movement of the drawbar and the handle to pivotal movement about said imaginary pivot axis.

9. The toggle type draw latch assembly of claim 8, wherein:

a) the handle is comprised of two substantially congruently extending handle members that are spaced apart at one location along their length, and that are rigidly connected together in at least one other location along their length where the handle members extend into engagement with each other;

b) the at least one hole formed through the handle includes aligned holes formed through the two handle members at said location where the handle members are spaced apart;

c) the elongate pivot pin extends through the aligned holes; and, d) the aligned holes are configured to receive the elongate pivot pin in a slip fit that strictly confines relative pivotal movement between the elongate pivot pin and the handle to pivotal movement about said imaginary pivot axis.

10. The toggle type draw latch assembly of claim 9 wherein the biasing means includes a torsion coil spring having coils that are reeved relatively loosely about a portion of the elongate pivot pin that extends between the aligned holes at said location where the handle members are spaced apart.

11. The toggle type draw latch assembly of claim 10 wherein:

a) a radially extending hole is formed in said portion of the elongate pivot pin that extends between the aligned holes, with the radially extending hole being located substantially mid-way between the two handle members;

b) an elongate pin member has one portion that is pressed into the radially extending hole, and another portion that projects radially outwardly from the radially extending hole; and, c) the biasing means includes a torsion coil spring that has:

1) a first end region that is connected to a first of the two handle members;

2) a second end region that is connected to a second of the two handle members;

3) a central region that is connected to said another portion of said elongate pin member near where said elongate pin member emerges from said radially extending hole;

4) a first set of coils that is formed integrally with said first end region and with said central region, and that are reeved loosely about the elongate pivot pin along a portion of the elongate pivot pin that extends between said first one of the two handle members and the location where the elongate pin member emerges from said radially extending hole; and, 5) a second set of coils that is formed integrally with said second end region and with said central region, and that are reeved loosely about the elongate pivot pin along a portion of the elongate pivot pin that extends between said second one of the two handle members and the location where the elongate pin member emerges from said radially extending hole.

12. The toggle type draw latch assembly of claim 7, wherein:

a) the handle is comprised of first and second substantially congruently extending handle members that are that spaced apart at one location along their length, and that are rigidly connected together in at least one other location along their length where the first and second handle members extend into engagement with each other;

b) the at least one hole formed through the handle includes first and second aligned holes that are formed through the first and second handle members, respectively, at said location where the first and second handle members are spaced apart;

c) the elongate pivot pin has first and second end regions that are generally cylindrical in shape, that are of substantially uniform diameter along their lengths, and that extend through the first and second aligned holes, respectively;

d) the elongate pivot pin also has an enlarged central region of generally spherical shape that extends between and connects the first and second end regions;

e) the first and second holes are sized to quite loosely receive the first and second end regions, but to not permit the enlarged central region to pass therethrough; and, f) bearing means for engaging and mounting the generally spherically shaped central region for movement relative to the first and second handle means about an imaginary point that is located along said imaginary axis centrally within the spherically shaped central region, with the bearing means including a first generally frusto-conically shaped bearing surface defined by the first hole for engaging one side of the spherically shaped central region adjacent where said one side of the central region joins with the first end region, and including second generally frusto-conically shaped bearing surface defined by the second hole for engaging an opposite side of the spherically shaped central region adjacent where said opposite side of the central region joins with the second end region.

13. The toggle type draw latch assembly of claim 12 wherein the biasing means includes a first torsion coil spring having a first set of coils that are reeved relatively loosely about the first end region of the elongate pivot pin, and a second torsion coil spring having a second set of coils that are reeved relatively loosely about the second end region of the elongate pivot pin.

14. The toggle type draw latch assembly of claim 13 wherein:

a) a first radially extending hole is formed in the first end region of the elongate pivot pin at a location spaced from the first handle member;

b) a second radially extending hole is formed in the second end region of the elongate pivot pin at a location spaced from the second handle member;

c) a first elongate pin member has one portion that is pressed into the first radially extending hole, and another portion that projects radially outwardly from the first radially extending hole;

d) a second elongate pin member has one portion that is pressed into the second radially extending hole, and another portion that projects radially outwardly from the second radially extending hole;

e) the first torsion coil spring has:

1) a first chosen end region that is connected to the first handle member;

2) a second chosen end region that is connected to the first elongate pin member portion that projects radially outwardly from the first radially extending hole; and, 3) said first set of coils is formed integrally with said first chosen end region and with the second chosen end region, and is reeved loosely about the first end region of the elongate pivot pin; and, f) the second torsion coil spring has:

1) a first designated end region that is connected to the second handle member;

2) a second designated end region that is connected to the second elongate pin member portion that projects radially outwardly from the second radially extending hole; and, 3) said second set of coils is formed integrally with said first designated end region and with the second designated end region, and is reeved loosely about the second end region of the elongate pivot pin.

15. The toggle type draw latch assembly of claim 1 wherein pivot pin means is provided for pivotally connecting the drawbar and the handle so that the drawbar can move relative to the handle, the pivot pin means includes an elongate pivot pin that extends through a hole formed through the handle, and connection means is provided for establishing a ball-swivel connection between the pivot pin means and the handle at a location near said hole.

16. The toggle type draw latch assembly of claim 1 wherein:

a) the handle is formed from two elongate handle members that extend side-by-side, that have portions located near said one end region that are spaced apart, and that have portions located near said opposite end region that engage for a continuous distance along a length of the handle that defines at least the hand grip;

b) first pivot pin means extends through aligned first holes formed through the spaced apart portions of the handle members and through at least one hole that is defined by the base for pivotally connecting the handle to the base;

c) a second pivot pin means extends through aligned second holes formed through the spaced apart portions of the handle members for pivotally connecting the drawbar to the handle; and, d) drawbar biasing means is provided for biasing the drawbar to pivot relative to the handle toward its retracted position including a torsion coil spring that extends about a portion of the second pivot pin means that is located between the spaced apart portions of the handle members.

17. The toggle type draw latch assembly of claim 16 wherein the torsion coil spring has one portion that is connected to the Second pivot pin means, and another portion that is connected to at least one of the handle members for biasing the pivot pin relative to the handle to bias the drawbar relative to the handle toward its retracted position.

18. The toggle type draw latch assembly of claim 17 additionally including projection means connected to the second pivot pin means and extending substantially radially therefrom at a location between the spaced apart portions of the handle members for establishing a connection between said one portion of the torsion coil spring and the second pivot pin means.

19. The toggle type draw latch assembly of claim 1 additionally including:

a) safety catch means movably connected to the base for extending adjacent the handle when the handle is in its closed position, with the safety catch means being connected to the base at a location that positions the safety catch means beside a selected portion of the handle that is located between said one and opposite end regions when the handle is in its closed position; and, b) catch engagement formation means connected to the handle and being movable therewith as the handle pivots relative to the base between said open and closed positions, with the safety catch engagement formation means including a catch engagement formation that is configured for engaging and being releasably retained by the safety catch means when the handle is in its closed position.

20. The toggle type draw latch assembly of claim 19 wherein the safety catch means includes a catch member that is pivotally connected to the base for movement between latched and unlatched positions, includes biasing means for biasing the catch member toward its latched position, is operable to engage and releasably retain the catch engagement formation when the handle is in its closed position and the catch member is in its latched position, and is configured such that, as the handle moves toward its closed position, the catch member is engaged by the catch engagement formation and is caused by such engagement to be cammed away from its latched position in opposition to the biasing action of the biasing means to permit the catch engagement formation to move into engaged, releasably retained relationship with the catch member when the handle reaches its closed position.

21. The toggle type draw latch assembly of claim 20 wherein the safety catch means defines first shackle engagement formation means for receiving the shackle of a padlock when the catch member is in its latched position, with the received shackle physically blocking movement of the catch member from its latched position to its unlatched position.

22. The toggle type draw latch assembly of claim 21 wherein the handle includes second shackle engagement formation means for receiving said shackle of said padlock that is received by the first shackle engagement formation means for enabling the padlock to establish a locked connection between the handle and the base that prevents pivotal movement of the handle from its closed position when the padlock lockingly engages its shackle.

23. In a toggle type draw latch assembly that has a base, an elongate operating handle pivotally connected to the base near one end region thereof for moving between an open position and a closed position wherein a portion of the handle is situated relatively near to the base, having a hand grip formed near the opposite end region thereof, having a drawbar pivotally connected to the handle at a location that is nearer to the one end region of the handle than to the hand grip, with the drawbar being pivotally movable relative to the handle between an extended position and a retracted position for engaging a latch-engageable formation to establish a connection between the latch assembly and the latch-engageable formation, the improvement comprising:

a) safety catch means movably connected to the base for extending adjacent the handle when the handle is in its closed position, with the safety catch means being connected to the base at a location that positions the safety catch means beside a selected portion of the handle that is located between said one and opposite end regions when the handle is in its closed position;

b) catch engagement formation means connected to the handle and being movable therewith as the handle pivots relative to the base between said open and closed positions, with the safety catch engagement formation means including a catch engagement formation that is configured for engaging and being releasably retained by the safety catch means when the handle is in its closed position;

c) wherein the safety catch means 1) includes a catch member that is pivotally connected to the base for movement between latched and unlatched positions, 2) includes biasing means for biasing the catch member toward its latched position, 3) is operable to engage and releasably retain the catch engagement formation when the handle is in its closed position and the catch member is in its latched position, and 4) is configured such that, as the handle moves toward its closed position, the catch member is engaged by the catch engagement formation and is caused by such engagement to be cammed away from its latched position in opposition to the biasing action of the biasing means to permit the catch engagement formation to move into engaged, releasably retained relationship with the catch member when the handle reaches its closed position; and, d) with the safety catch means also defining first shackle engagement formation means for receiving the shackle of a padlock when the catch member is in its latched position, with the received shackle physically blocking movement of the catch member from its latched position to its unlatched position.

24. The toggle type draw latch assembly of claim 23 wherein the handle includes second shackle engagement formation means for receiving said shackle of said padlock that is received by the first shackle engagement formation means for enabling the padlock to establish a locked connection between the handle and the base that prevents pivotal movement of the handle from its closed position when the padlock lockingly engages its shackle.

25. The toggle type draw latch assembly of claim 23 additionally including drawbar biasing means for biasing the drawbar to pivot relative to the handle toward its retracted position. .

26. The toggle type draw latch assembly of claim 25 wherein:

a) the handle is formed from two elongate handle members that extend side-by-side, that have portions located near said one end region that are spaced apart, and that have portions located near said opposite end region that engage for a continuous distance along a length of the handle that defines at least the hand grip;

b) first pivot pin means extends through aligned first holes formed through the spaced apart portions of the handle members and through at least one hole that is defined by the base for pivotally connecting the handle to the base;

c) a second pivot pin means extends through aligned second holes formed through the spaced apart portions of the handle members for pivotally connecting the drawbar to the handle; and, d) the drawbar biasing means for biasing the drawbar to pivot relative to the handle toward its retracted position includes at least one torsion coil spring that extends about at least one portion of the second pivot pin means.

27. The toggle type draw latch assembly of claim 26 wherein the torsion coil spring has one portion that is connected to the second pivot pin means, and another portion that is connected to at least one of the handle members for biasing the second pivot pin means relative to the handle to bias the drawbar relative to the handle toward its retracted position.

28. The toggle type draw latch assembly of claim 27 additionally including projection means connected to the second pivot pin means and extending substantially radially therefrom at a location between the spaced apart portions of the handle members for establishing a connection between said one portion of the torsion coil spring and the second pivot pin means.

29. The toggle type draw latch assembly of claim 23 additionally including:

a) means for adjusting the effective length of the drawbar within a given range of adjustment, with such adjustment affecting the nearness of the drawbar to the hand grip when the handle is in its retracted position;

b) first stop formation means connected to the handle for defining drawbar engaging surface means at a location near the hand grip for being engaged by the drawbar when the drawbar is in its retracted position;

c) with the drawbar engaging surface means including a surface that extends for a sufficient distance along the length of the handle at said location near the hand grip for being engaged by the drawbar when the drawbar is in its retracted position regardless of where within said given range of adjustment the means for adjusting the effective length of the drawbar is set; and, d) with the drawbar engaging surface being configured to ensure that the retracted position of the drawbar is held at a sufficiently far distance away from the location of the hand grip to ensure that, regardless of where within said given range of adjustment the means for adjusting the effective length of the drawbar is set, the retracted drawbar will not so closely approach the hand grip as to endanger portions of a hand that is gripping the hand grip being contacted by the retracted drawbar.

30. The toggle type draw latch assembly of claim 29 wherein the hand grip extends about an imaginary centerline that generally parallels the length of the elongate handle so as to extend through said one and opposite end regions of the handle, and the drawbar engaging surface is configured to extend progressively farther from said centerline the closer that it approaches the hand grip.

31. The toggle type draw latch assembly of claim 30 wherein the drawbar engaging surface is planar in character in that it extends substantially within a common plane that is inclined relative to said centerline so as to more closely approach the centerline as it extends away from the hand grip.

32. The toggle type draw latch assembly of claim 29 wherein the handle also defines second stop formation means connected to the handle for defining base engaging surface means at a location that is near the location where the drawbar is pivotally connected to the handle for engaging the base when the handle is pivoted to said closed position to define the closed position of the handle.

33. The toggle type draw latch assembly of claim 32 wherein the base engaging surface means presents a convexly curved surface that engages the base when the handle is in its closed position.

34. The toggle type draw latch assembly of claim 23 wherein 1) the handle has at least one hole formed therethrough, 2) an elongate pivot pin has a central portion that extends through said at least one hole, 3) the elongate pivot pin means for mounting the drawbar is pivotally connected to the handle for movement relative to the handle about an imaginary pivot axis that extends centrally along the length-of the elongate pivot pin.

35. The toggle type draw latch assembly of claim 23 wherein pivot pin means is provided for pivotally connecting the drawbar and the handle so that the drawbar can move relative to the handle, the pivot pin means includes an elongate pivot pin that extends through a hole formed through the handle, and connection means is provided for establishing a ball-swivel connection between the pivot pin means and the handle at a location near said hole.

36. A handle operated toggle-type draw latch assembly for mounting on one of two members for engaging a latch-engageable formation connected to the other of the two members for exerting force on the two members that tends to draw the two members relatively toward each other and for releasably retaining the two members in joined relationship, comprising:

a) base means including base structure for being connected to a mounting surface of said one of two members that are to be joined and releasably retained in joined relationship, for defining handle mounting means that extends away from the mounting surface, for defining safety catch mounting means that extends away from the mounting surface at a location spaced along the mounting surface from the location of the handle mounting means, with a first imaginary pivot axis being defined by the handle mounting means, and with a third imaginary pivot axis being defined by the safety catch mounting means;

b) first pivot pin means connected to the handle mounting means at the first location and being configured to extend along the first pivot axis;

c) handle means including an elongate handle having opposed first and second end regions, for defining pivot pin receiving means located near the first end region and extending about the first pivot axis to receive portions of the first pivot pin means to pivotally connect the handle means to the base means, for defining first and second stop formations located along the length of the handle between the first and second end regions, for defining a catch-engageable formation located along the length of the handle between the first and second stop formations, for being connected to the handle mounting means for pivotal movement relative to the base means about the first pivot axis in a "closing" direction of movement toward a closed position wherein the handle relatively closely overlies the mounting surface and wherein the first stop formation engages the base means to prevent further relative movement of the handle in said "closing" direction of movement, and in an "opening" direction of movement that extends oppositely about the first pivot axis toward an open position wherein the handle extends generally away from the mounting surface, and for defining a second pivot axis that extends transversely to the length of the handle in a direction that substantially parallels the first pivot axis but is spaced along the length of the handle from the first pivot axis;

d) second pivot pin means connected to the handle and being configured to extend generally along the second pivot axis;

e) drawbar means including an elongate drawbar for being connected to the second pivot pin means for pivotal movement relative to the handle for selectively being brought into engagement with the latch-engageable formation when the handle is pivoted to its open position, and for transmitting force to and establishing a joining connection with the latch-engageable formation when the handle is moved to its closed position while the drawbar means is engaging the latch-engageable formation, and for being pivoted to a retracted position wherein the drawbar engages the second stop formation of the handle;

f) third pivot pin means connected to the safety catch mounting means at the second location along the base means and being configured to extend along the third pivot axis; and, g) safety catch means including a safety catch member for being pivotally connected by the third pivot pin means to the base means for pivotal movement relative to the base means about the third pivot axis between latched and unlatched positions, for defining a safety catch formation engagement means for receiving and releasably retaining the safety catch formation of the handle when the handle is pivoted to its closed position and when the safety catch is pivoted to its latched position, and including biasing means interposed between the base means and the safety catch member for biasing the safety catch member away from its unlatched position toward its latched position.

37. The latch assembly of claim 36 wherein the safety catch formation is configured to engage and cam the catch member out of its latched position toward its unlatched position as the handle is moved toward its closed position.

38. The latch assembly of claim 36 wherein the connection of the drawbar to the second pivot pin means is adjustable to control the length of the drawbar relative to the second pivot axis so as to influence where along the length of the handle that the drawbar engages the second stop formation when the drawbar is retracted, and the second stop formation defines an elongate surface that will be engaged by the drawbar regardless of where within its range of adjustment that the connection of the drawbar to the second pivot pin is set.

39. The latch assembly of claim 38 wherein:

a) handgrip formation means is defined by the handle near the second end region for extending along an imaginary centerline of the handle that intercepts both of the first and second end regions for being configured to be gripped by one's hand in order to pivot the handle about the first pivot axis; and, b) the elongate surface of the second stop formation is inclined relative to said center axis for holding the retracted drawbar at an increasing distance from the handgrip as the effective length of the drawbar brings the portion of the drawbar that engages the second stop surface closer to the handgrip.

40. The latch assembly of claim 36 wherein the drawbar is rigid U-shaped member.

41. The latch assembly of claim 36 wherein the drawbar is a rigid V-shaped member.

42. The latch assembly of claim 36 wherein the drawbar is a U-shaped structure including rigid formation means for being connected to the second pivot pin means, and having non-rigid formation means connected to the rigid formation means for permitting at least one portion of the U-shaped structure to move relative to said rigid formation means.

43. The latch assembly of claim 42 wherein the non-rigid formation means is defined at least in part by at least one reach of flexible cable.

44. The latch assembly of claim 42 wherein said at least one portion of the U-shaped structure is defined by an elongate tubular member through which a length of flexible cable extends, and said at least one reach of flexible cable includes a first reach of flexible cable that extends from one end of the elongate tubular member and connects to the second pivot pin means, and a second reach of flexible cable that extends from the other end of the elongate tubular member and connects to the second pivot pin means.

45. The latch assembly of claim 44 wherein the length of tubular cable that extends through the tubular member is rigidly connected to the tubular member, and the first and second reaches of flexible cable are formed integrally with said length of flexible cable.

46. In a toggle type draw latch assembly that has a base, an elongate operating handle pivotally connected to the base near one end region thereof for moving between an open position and a closed position wherein a portion of the handle is situated relatively near to the base, having a hand grip formed near the opposite end region thereof, having a drawbar pivotally connected to the handle at a location that is nearer to the one end region of the handle than to the hand grip, with the drawbar being pivotally movable relative to the handle between an extended position and a retracted position wherein a portion of the drawbar is situated relatively near to the hand grip, the improvement comprising means establishing a ball-swivel connection between the drawbar and the handle to permit the drawbar to move a limited amount in substantially any direction relative to the handle about a point that is located along the length of the elongate operating handle.

47. The latch assembly of claim 46 wherein the drawbar is rigid U-shaped member.

48. The latch assembly of claim 46 wherein the drawbar is a rigid V-shaped member.

49. The latch assembly of claim 46 wherein the drawbar is a U-shaped structure including rigid formation means for being connected to the second pivot pin means, and having non-rigid formation means connected to the rigid formation means for permitting at least one portion of the U-shaped structure to move relative to said rigid formation means.

50. The latch assembly of claim 49 wherein the non-rigid formation means is defined at least in part by at least one reach of flexible cable.

51. The latch assembly of claim 49 wherein said at least one portion of the shaped structure is defined by an elongate tubular member through which a length of flexible cable extends, and said at least one reach of flexible cable includes a first reach of flexible cable that extends from one end of the elongate tubular member and connects to the second pivot pin means, and a second reach of flexible cable that extends from the other end of the elongate tubular member and connects to the second pivot pin means.

52. The latch assembly of claim 51 wherein the length of tubular cable that extends through the tubular member is rigidly connected to the tubular member, and the first and second reaches of flexible cable are formed integrally with said length of flexible cable.

* * * * *